US005739641A

United States Patent [19]

Nakamura et al.

[11] Patent Number: 5,739,641

[45] Date of Patent: Apr. 14, 1998

[54] CIRCUIT FOR DRIVING PLASMA DISPLAY PANEL

[75] Inventors: Tadashi Nakamura; Masahiro Shimizu, both of Tokyo, Japan

[73] Assignee: NEC Corporation, Tokyo, Japan

[21] Appl. No.: 630,220

[22] Filed: Apr. 10, 1996

[30] Foreign Application Priority Data

Apr. 10, 1995 [JP] Japan ..... 7-083911

[51] Int. Cl.[6] ..... G09G 3/28

[52] U.S. Cl. ..... 315/169.1; 315/169.4; 345/211; 345/204; 345/61

[58] Field of Search ..... 345/60, 211, 61, 345/67, 68, 204; 313/581, 582, 583, 584, 585, 586; 315/169.1, 169.4

[56] References Cited

FOREIGN PATENT DOCUMENTS 62-119585 5/1987 Japan .

4127192 4/1992 Japan .

5249916 9/1993 Japan .

5265397 10/1993 Japan .

*Primary Examiner*—Robert Pascal

*Assistant Examiner*—Arnold Kinkead

*Attorney, Agent, or Firm*—Whitham, Curtis, Whitham & McGinn

[57] ABSTRACT

A circuit for driving a plasma display panel includes a scan pulse drive integrated circuit having a plurality of output terminals, and a diode array composed of a corresponding number of diodes each having a cathode connected to a corresponding one of the plurality of output terminals. Anodes of all the diodes are connected in common to one end of a first switch having the other end connected to ground. A high voltage side power supply terminal of the scan pulse driving circuit is connected through a second switch to a negative power supply. During a hold period, the first switch is turned on, but the second switch is turned off, so that a discharge current flows through the diode array to display cells of the plasma display panel, without passing through the inside of the scan pulse driving circuit.

14 Claims, 16 Drawing Sheets

CIRCUIT FOR DRIVING PLASMA DISPLAY PANEL

BACKGROUND OF THE INVENTION

1. Field of the Invention

The present invention relates to a circuit for driving a plasma display panel, and more specifically to a plasma display panel driving circuit for driving a scan hold electrode in a plasma display panel.

2. Description of Related Art

In general, a plasma display panel has various advantages in that it has a very thin structure; it has no flicker; it has a large display contrast ratio; it is possible to form a relatively large screen; it has a high response speed; and a multicolor light emission is possible by using a phosphor of a spontaneous light emission type. Therefore, the plasma display panel has been recently widely utilized in a field of a computer related display device and in a field of a color image display.

An operation type of this plasma display panel is divided into an AC discharge type in which electrodes are coated with a dielectric so that the plasma display panel is operated in an redirect AC discharge condition, and a DC discharge type in which electrodes are exposed to a discharge space so that the plasma display panel is operated in a DC discharge condition. A driving type for the AC discharge type plasma display panel is further divided into a memory operation type in which a memory function of a discharge cell is utilized, and a refresh operation type in which the memory of the discharge cell is not utilized. Luminance or brightness of the AC discharge type plasma display panel is in proportion to the number of discharges, namely, the repetition number of pulse voltages. In the refresh operation type, the luminance lowers with enlargement of a display capacitance, and therefore, the refresh operation type is used in a plasma display panel having a small display capacitance.

Referring to FIG. 1, there is shown a diagrammatic sectional view of one display cell of the AC discharge, memory operation type of plasma display panel. This display cell includes a front surface insulating substrate 11 and a back surface insulating substrate 5, which are formed of a glass, and located to oppose to each other. On an inner surface of the back surface insulating substrate 5, a scan electrode 3 and a hold electrode 6 are formed, and on an inner surface of the front surface insulating substrate 11, a data electrode 10 is formed orthogonally to the scan electrode 3 and the hold electrode 6. Furthermore, in a space between the insulating substrates 11 and 5, a discharge gas space 4 is defined by a partition 9, which ensures the discharge gas space 4 and also confines each display cell. The discharge gas space, 4 is filled with a discharge gas formed of for example, helium, neon, xenon, or their mixed gas. In addition, in the space between the insulating substrates 11 and 5, the scan electrode 3 and the hold electrode 6 are. Covered with a dielectric layer 2, which is in turn covered with a protection layer 7 formed of a magnesium oxide for protecting the dielectric layer 2 from a discharging current. The data electrode 10 is covered with a dielectric layer 9, on which a phosphor layer 8 is formed for converting an ultraviolet ray emitted from the discharge gas, into a visible light.

Now, operation of a selected one display cell of the AC discharge, memory operation type of plasma display panel will be described with reference to FIG. 1. A pulse voltage, namely, a data pulse having a voltage exceeding a discharge threshold level is applied between the scan electrode 3 and the data electrode 10, to initiate the discharging. As a result, depending upon the polarity of the data pulse applied, positive and negative electric charges are attracted and accumulated on respective surfaces of the dielectric layers 2 and 9. An equivalent internal voltage attributable to these accumulated electric charges, namely, a wall voltage is in a polarity opposite to that of the data pulse applied, and therefore, an effective voltage within the cell drops with a growth of the above mentioned discharge. Accordingly, although the data pulse applied continues to maintain a constant voltage, it is not possible to maintain the discharge, so that the discharge will finally stop.

Thereafter, a hold pulse, which is a pulse voltage having the same polarity as that of the above mentioned wall voltage, is applied between the scan electrode 3 and the hold electrode 6 adjacent to each other. Since the hold pulse is effectively superimposed with the above mentioned wall voltage, even if the hold pulse is small in voltage amplitude, the superimposed voltage exceeds the discharge threshold level. Thus, by continuing to apply the hold pulse between the scan electrode 3 and the hold electrode 6 adjacent to each other, it is possible to maintain the above mentioned discharge. This function in the above mentioned memory function.

Additionally, it is possible to stop the above mentioned discharge, by applying to the scan electrode 3 or the hold electrode 6, an erase pulse which is a low voltage pulse having a magnitude or width sufficient to neutralize the above mentioned wall voltage.

Referring to FIG. 2, there is illustrated a conventional electrode arrangement of the above mentioned AC discharge, memory operation type of plasma display panel. In a dot matrix displaying plasma display panel 12A, a number of display cells 13A, each of which is symbolically depicted by a small circle, are located in the form of a matrix having "j" rows and "k" columns. The plasma display panel 12A includes scan electrodes Sc1, Sc2, . . . , Scj and hold electrodes Su1, Su2, . . . , Suj, which are located in parallel to one another, and data electrodes D1, D2, . . . , Dk which are located in parallel to one another but orthogonal to the scan electrodes Sc1, Sc2, . . . , Scj and the hold electrodes Su1, Su2, . . . , Suj. A full color display plasma display panel can be realized by dividing the phosphor (designated by Reference Numeral 8 in FIG. 1) into primary colors of red, green and blue.

Here, operation of the plasma display panel shown in FIG. 2 will be described with reference to FIG. 3 showing a timing chart illustrating a driving voltage waveform COM in the prior art. In FIG. 3, the waveform "A" shows a driving voltage waveform of a common hold electrode applied to the hold electrodes Su1 to Suj, and the waveforms "B", "C" and "D" illustrate scan electrode driving voltage waveforms S1, S2 and Sj applied to the. Scan electrodes Sc1, Sc2 and Scj, respectively. The waveform "E" shows a dam electrode driving voltage waveform DATA applied to the data electrode Di ($1 \leq i \leq k$).

One period of the driving includes a predischarge period 60, a scan write period 61 and a hold period. In the predischarge period 60, active particles and wall electric charges are generated within the discharge gas space 4, in order to obtain a stable write discharge characteristic in the scan write period 61. In all of the display cells in the plasma display panel 12A, the discharge is simultaneously caused, and the erasure is also simultaneously performed.

In the scan write period 61, a scan pulse 16 is sequentially applied to the scan electrodes Sc1, Sc2, . . . , Scj at a different timing independently of each other, so that a write discharge is caused in the order of a line scanning. For example, when a writing is made to the display cell 13A in a first row and an "i"th column of the plasma display panel 12A, a data pulse 20 is applied in synchronism with a timing of applying the scan pulse 16 of the driving voltage waveform S1, so that a discharge is generated between the scan electrode Sc1 and the data electrode Di. In the case that no writing is made, no data pulse is applied.

In the hold period 62, under the above mentioned memory function of the display cell, the discharge is maintained in the display cell which has been discharged for writing the scan write period 61. A discharge is repeated between the hold electrode and the scan electrode by a hold pulse 18 shown in the waveform "A" of FIG. 3 and a hold pulse 19 shown in the waveforms "B", "C" to "D" of FIG. 3, so that a lighting is maintained. An erase pulse 14 shown in the waveforms "B", "C" to "D" of FIG. 3 is applied to the scan electrodes, the discharge stops, so that the lighting is extinguished.

Next, examples of a conventional plasma display panel driving circuit for generating the above mentioned scan electrode driving voltage waveforms, will be described.

Referring to FIG. 4, there is shown a block diagram of a conventional plasma display panel driving circuit disclosed in Japanese Patent Application Laid-open Publication No. JP-A-05-249916, the disclosure of which is incorporated by reference in its entirety into the present application. This shown circuit includes a hold pulse driving circuit and a scan pulse driving circuit.

The scan pulse driving circuit is designated by Reference Numeral 21, and is formed on an integrated circuit. The scan pulse driving circuit includes a number of output circuits, each of which includes a pair of switching devices 30 and 31 connected in a push-pull form, and a pair of reverse voltage preventing diodes 32 and 33 connected to the switch elements 30 and 31, respectively. A connection node between each pair of switch elements 30 and 21 is connected to an output terminal OUT1 to OUTm, which is connected to a different scan electrode.

In response to a plurality of control signals 27 applied to the scan pulse driving circuit, a shift register 28 and a latch circuit 29 cooperate to generate control signals for the switch elements 30 and 31, so as to switch on or off these switch elements 30 and 31, whereby a scan pulse is outputted from each of the output terminal OUT1 to OUTm.

Between ground and a negative terminal of a power supply VSSCAN, a switch element 22A, diodes 23A and 25A and a switch element 24A are connected in the named order, which constitute the hold pulse driving circuit. A connection node between the diodes 23A and 25A is connected to a high voltage side power supply terminal 63 of the scan pulse driving circuit 21, and a low voltage side power supply terminal 64 of the scan pulse driving circuit 21 is connected to a negative power supply VW. The switch elements 22A and 24A are on-off controlled by a control signal supplied from a hold pulse switching control signal output circuit 26A, so that the hold pulse driving circuit, namely, the output node between the diodes 23A and 25A, is connected to the output terminals, so that the scan pulse voltage waveform is superimposed on the hold pulse voltage waveform, with the result that the scan electrode is driven with the superimposed voltage pulse.

Referring to FIG. 5, there is shown a block diagram of another conventional plasma display panel driving circuit disclosed in Japanese Patent Application Laid-open Publication No. JP-A-05-265397, the disclosure of which is incorporated by reference in its entirety into the present application. In FIG. 5, elements similar to those shown in FIG. 4 are given the same Reference Numerals, and explanation thereof will be omitted.

This second conventional example includes a first diode array 34B composed of "m" diodes, each of which has an anode connected through a switch element 22B to ground and the high voltage side power supply terminal 63 of the scan pulse driving circuit 21, and a cathode connected to a corresponding one of the output terminals OUT1 to OUTm of the scan pulse driving circuit 21. The second conventional example also includes a second diode array 35B composed of "m" dimes, each of which has a cathode connected through a switch element 24B to the negative power supply VSSCAN, and an anode connected to a corresponding one of the output terminals OUT1 to OUTm of the scan pulse driving circuit 21.

With this arrangement, the switch elements 22B and 24B are on-off controlled by switching control signals supplied from a switching control signal output circuit 26B, so that a hold pulse generated by the switch elements 22B and 24B, is supplied through the diode arrays 34B and 35B to the output terminals OUT1 to OUTm, through no intermediary of the scan pulse driving circuit 21. Thus, the hold pulse is mixed with the scan pulse generated by the scan pulse driving circuit 21. In this example, during a period of continuing to outputting the hold pulse, the output of the scan pulse driving circuit 21 is put in a high impedance condition.

In the above mentioned first conventional driving circuit shown in FIG. 4, all of the driving current such as a charging current or a discharging current of an electrostatic capacitance of the plasma display panel caused by the hold pulse, flows through the scan pulse driving circuit 21 which is formed on the integrated circuit, and therefore, a consumed electric power of the driving circuit is excessively large, and a generated heat amount becomes large.

On the other hand, in the above mentioned second conventional driving circuit shown in FIG. 5, it is necessary to have a high impedance function in an output part of the scan pulse driving circuit 21, with the result that a complicated control and a complicated circuit construction are required, and therefore, the cost of the circuit increases.

SUMMARY OF THE INVENTION

Accordingly, it is an object of the present invention to provide a plasma display panel driving circuit which has overcome the above mentioned defects of the conventional ones.

Another object of the present invention is to provide a plasma display panel driving circuit capable of driving a plasma display panel having a large capacitance, with a scan pulse driving circuit of a lower consumed electric power.

The above and other objects of the present invention are achieved in accordance with the present invention by a circuit for driving scan hold electrodes in a plasma display panel which comprises at least a plurality of scan hold electrodes having a scan electrode function and a hold electrode function, and a plurality of data electrodes orthogonal to the scan hold electrodes, the circuit comprising:

a scan pulse drive circuit formed of an integrated circuit and having a plurality of output terminals for outputting scan pulses to the scan hold electrodes;

a first diode army composed of a plurality of diodes, each having a cathode connected to a corresponding one of the plurality of output terminals;

a first switch element connected between an anode of each of the plurality of diodes of the first diode array and a first power supply;

a second switch element connected between a high voltage side power supply terminal of the scan pulse driving circuit and a second power supply having a potential lower than that of the first power supply; and a pulse control circuit for alternately turning on the first switch and the second switch at least during a hold period.

In a first variation of the present invention, the circuit further includes a third switch element connected between the high voltage side power supply terminal of the scan pulse driving circuit and a third power supply having a potential lower than that of the first power supply, and wherein the pulse control circuit controls an on-off switching of the third switch element at least during a scan write period.

Preferably, an impedance element is inserted between the high voltage side power supply terminal of the scan pulse driving circuit and the second and third switch elements.

In a second variation of the present invention, the circuit further includes a second diode array composed of a plurality of diodes, each having an anode connected to a corresponding one of the plurality of output terminals, a cathode of each diode in the second diode array being connected to the high voltage side power supply terminal of the scan pulse driving circuit.

According to another aspect of the present invention, there is provided a circuit for driving scan hold electrodes in a plasma display panel which comprises at least a plurality of scan hold electrodes having a scan electrode function and a hold electrode function, and a plurality of data electrodes orthogonal to the scan hold electrodes, the circuit comprising:

a scan pulse drive circuit formed of an integrated circuit and having a plurality of output terminals for outputting scan pulses to the scan hold electrodes;

a first diode array composed of a plurality of diodes, each having a cathode connected to a corresponding one of the plurality of output terminals;

a second diode array composed of a plurality of diodes, each having an anode connected to a corresponding one of the plurality of output terminals;

a first switch element connected between an anode of each of the plurality of diodes of the first diode army and a first power supply;

a second switch element connected between a cathode of each of the plurality of diodes of the second diode array and a second power supply;

a third switch element connected between a high voltage side power supply terminal of the scan pulse driving circuit and a third power supply having a potential lower than that of the first power supply; and a pulse control circuit for alternately turning on the first switch and the third switch at least during a hold period, the pulse control circuit controlling an on-off switching of the second switch element at least during a scan write period.

In a preferred embodiment, the circuit further includes:

a fourth switch element and a fifth switch element;

a timing control circuit for controlling an on-off switching of each of the fourth switch element and the fifth switch element;

a first series circuit composed of a first coil and a first reverse-current preventing diode and connected between the high voltage side power supply terminal of the scan pulse driving circuit and one end of the fourth switch element;

a second series circuit composed of a second coil and a second reverse-current preventing diode and connected between a common connection node between the anode of the diodes of the first diode array and one end of the fifth switch element; and a capacitor having one end thereof connected to the other end of each of the fourth switch element and the fifth switch element and the first power supply.

Prefarably, an impedance element is inserted between the high voltage side power supply terminal of the scan pulse driving circuit and a common connection node between the second and third switch elements, the second diode array and the first series circuit.

In another preferred embodiment, the circuit further includes:

a fourth switch element and a fifth switch element;

a timing control circuit for controlling an on-off switching of each of the fourth switch element and the fifth switch element;

a first series circuit composed of a first coil and a first reverse-current preventing diode and connected between a common connection node between the cathode of the diodes of the second diode array and one end of the fourth switch element;

a second series circuit composed of a second coil and a second reverse-current preventing diode and connected between a common connection node between the anode of the diodes of the first diode array and one end of the fifth switch element; and a capacitor having one end thereof connected to the other end of each of the fourth switch element and the fifth switch element and the first power supply.

In still another preferred embodiment, the circuit further includes:

a fourth switch element and a fifth switch element;

a timing control circuit for controlling an on-off switching of each of the fourth switch element and the fifth switch element;

a coil having one end thereof connected to the high voltage side power supply terminal of the scan pulse driving circuit;

a first reverse-current preventing diode having an anode connected to the other end of the coil and a cathode connected to one end of the fourth switch element;

a second reverse-current preventing diode having a cathode connected to the other end of the coil and an anode connected to one end of the fifth switch element;

a capacitor having one end thereof connected to the other end of each of the fourth switch element and the fifth switch element and the first power supply.

Also in this embodiment, preferably, an impedance element is inserted between the high voltage side power supply terminal of the scan pulse driving circuit and a common connection node between the second and third switch elements, the second diode army and the coil.

In another variant of the present invention, the circuit further includes a sixth switch element having one end thereof connected to a low voltage side power supply terminal of the scan pulse driving circuit and the other end thereof connected to a fourth power supply having a potential lower than that of the second power supply. The sixth switch element is turned on together the third switch element at least during the scan write period, but being turned off during the hold period.

The above and other objects, features and advantages of the present invention will be apparent from the following description of preferred embodiments of the invention with reference to the accompanying drawings.

DESCRIPTION OF THE PREFERRED EMBODIMENTS

Figure 4:
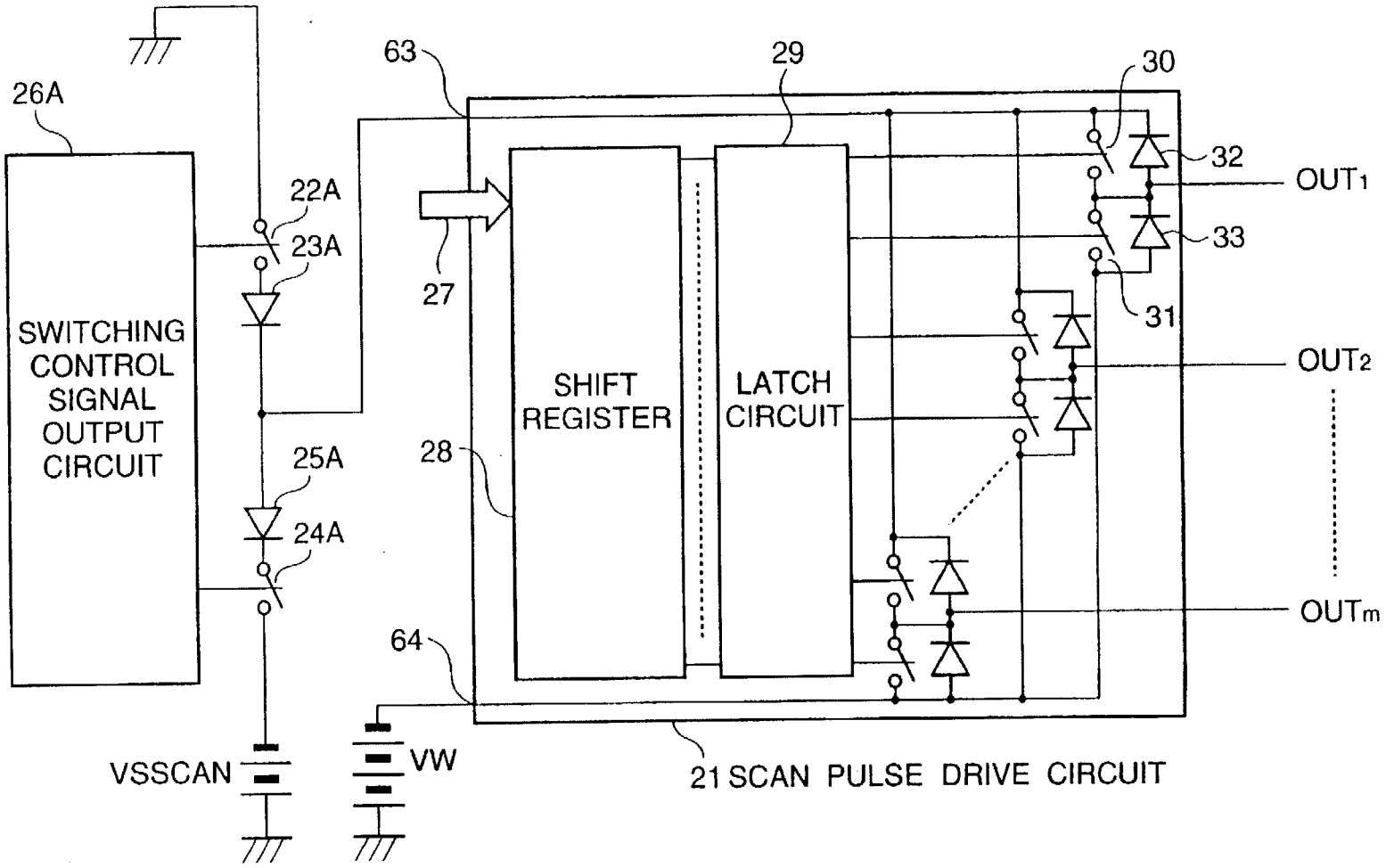
FIGURE 4 PRIOR ART
FIG. 4 is a block diagram of a first conventional plasma display panel driving circuit.
Figure 5:
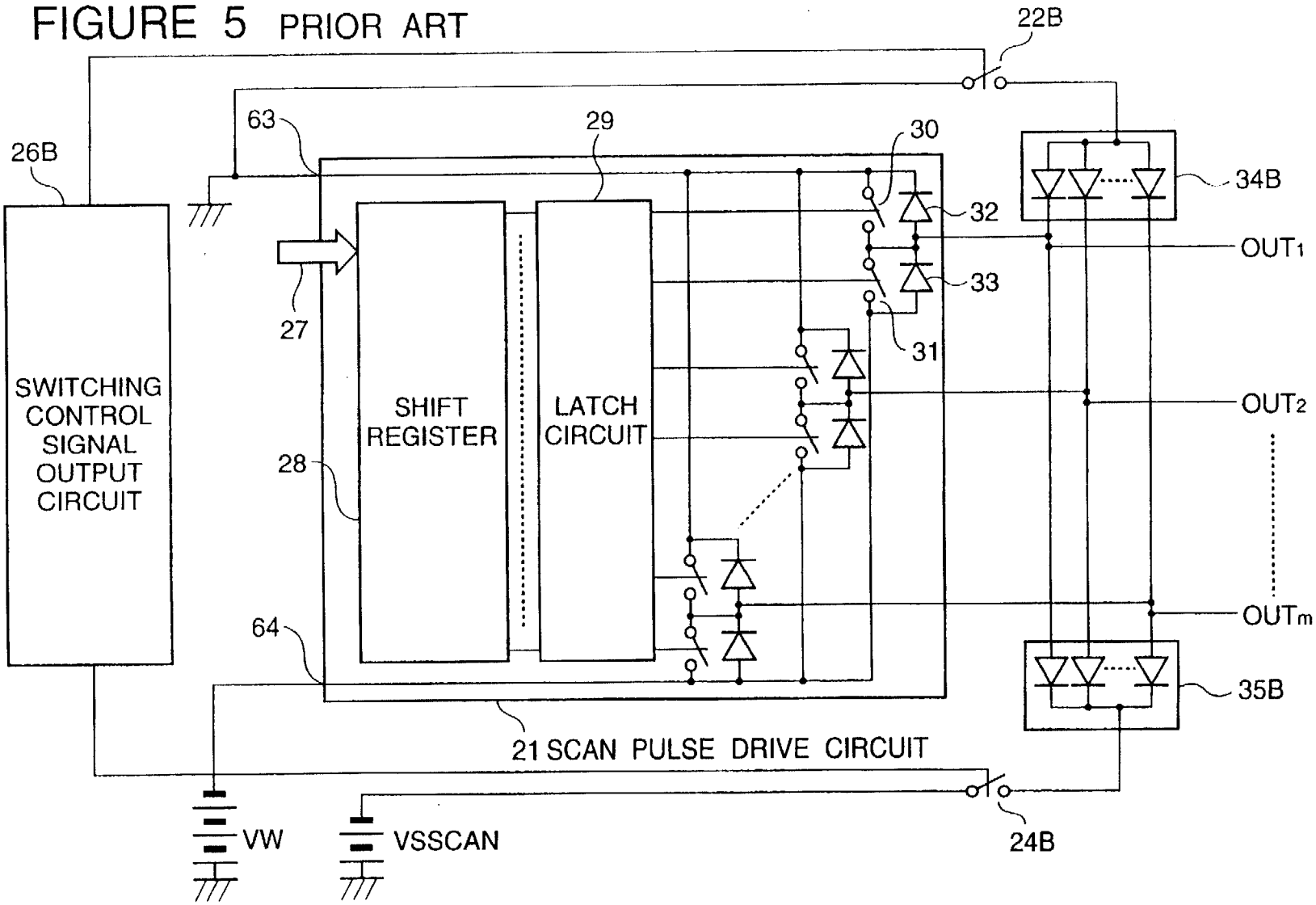
FIGURE 5 PRIOR ART
FIG. 5 is a block diagram of a second conventional plasma display panel driving circuit.
Figure 6:
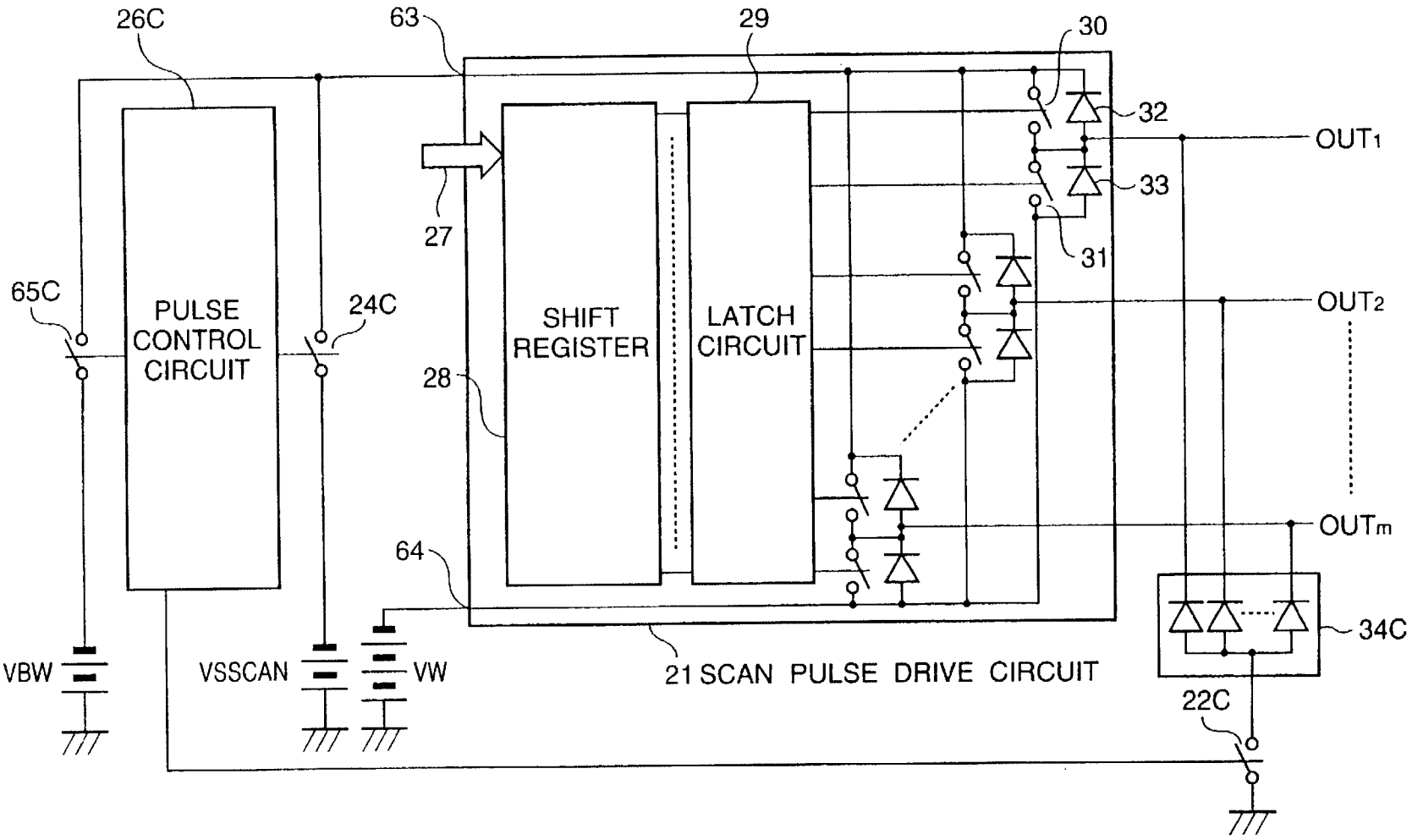
FIG. 6 is a block diagram of a first embodiment of the plasma display panel driving circuit in accordance with the present invention.

Referring to FIG. 6, there is shown a block diagram of a first embodiment of the plasma display panel driving circuit in accordance with the present invention. In FIG. 6, elements similar to those shown in FIGS. 4 and 5 are given the same Reference Numerals, and explanation thereof will be omitted.

The first embodiment of the plasma display panel driving circuit shown in FIG. 6 includes switch elements 22C and 24C having one end thereof connected to ground and a negative power supply VSSCAN, respectively, for the purpose of fixing a potential of the hold pulse, a switch element 65C having one end thereof connected to a negative power supply VBW for the purpose of fixing a reference potential of the scan pulse, a pulse control circuit 26C for generating control pulses supplied to the switch elements 22C, 24C and 65C, respectively, a scan pulse drive circuit 21 and a diode array 34C for supplying the hold current and shunting the drive current. The scan pulse drive circuit 21 is the same in construction and in operation as that included in the conventional plasma display panel driving circuits explained hereinbefore, and formed on an integrated circuit.

A circuit composed of switch elements 30 and 31 and diodes 32 and 33 provided for each of the "m" output terminals OUT1 to OUTm of the scan pulse driving circuit 21, and is connected at its one end to the other end of the switch elements 24C and 65C through the high voltage side power supply terminal 63 of the scan pulse driving circuit 21, and at its other end to the negative power supply VW through the low voltage side power supply terminal 64 of the scan pulse driving circuit 21.

More specifically, the switch elements 30 and 31 are connected in series between the high voltage side power supply terminal 63 and the low voltage side power supply terminal 64 of the scan pulse driving circuit 21. The diode 32 has a cathode connected to the high voltage side power supply terminal 63 of the scan pulse driving circuit 21, and an anode connected between a connection node between the switch elements 30 and 31. The diode 33 has an anode connected to the low voltage side power supply terminal 64 of the scan pulse driving circuit 21, and a cathode connected to the connection node between the switch elements 30 and 31.

The diode array 34C includes "m" diodes of the same number as that of the output terminals OUT1 to OUTm of the scan pulse driving circuit 21. Anodes of the "m" diodes are connected in common to one end of a switch element 22C having the other end connected to ground. A cathode of each of the "m" diodes is connected to a corresponding one of the output terminals OUT1 to OUTm of the scan pulse driving circuit 21.

Now, operation, in the hold period, of the first embodiment will described with reference to a timing chart of FIG. 7.

Before a time t1, the switch elements 22C and 30 are on, and the switch elements 24C, 65C and 31 are off. At the time t1, the switch element 24C is turned on and the switch element 22C is turned off, so that a charging current 50A is supplied through the diode 32 to the display cells of the plasma display panel, as shown in the waveform "C" of FIG. 7, and the output terminals OUT1 to OUTm are clamped to the hold pulse voltage VSSCAN as shown in the waveform "A" of FIG. 7, until a time t2.

Figure 7:
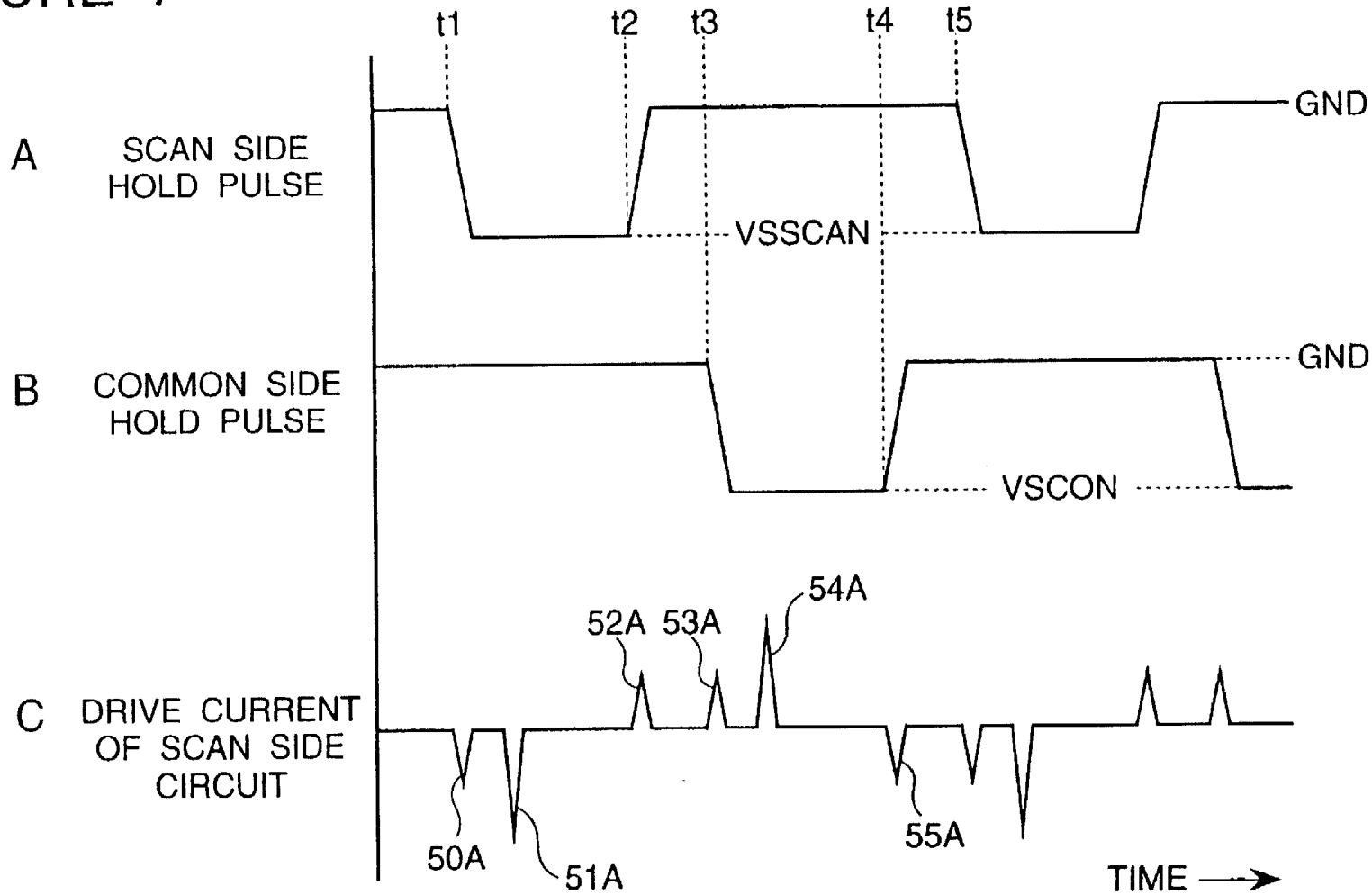
FIG. 7 is a timing chart illustrating an operation, during a hold period, of the plasma display panel driving circuit in accordance with the present invention.

At the time t2, the switch element 24C is turned off, and the switch element 22C is turned on, so that a discharge current 52A flows in the display cells of the plasma display panel through the diode array 34C, as shown in the waveform "C" of FIG. 7. Thereafter, the output terminals OUT1 to OUTm are clamped to the ground level as shown in the waveform "A" of FIG. 7 until a time t5. The discharge current 52A does not flow through the scan pulse drive circuit 21, and all of the discharge current 52A flows through the diode array 34C. The above mentioned sequence is repeated so that the hold pulse is outputted as shown in the waveform "A" of FIG. 7.

Figure 3:
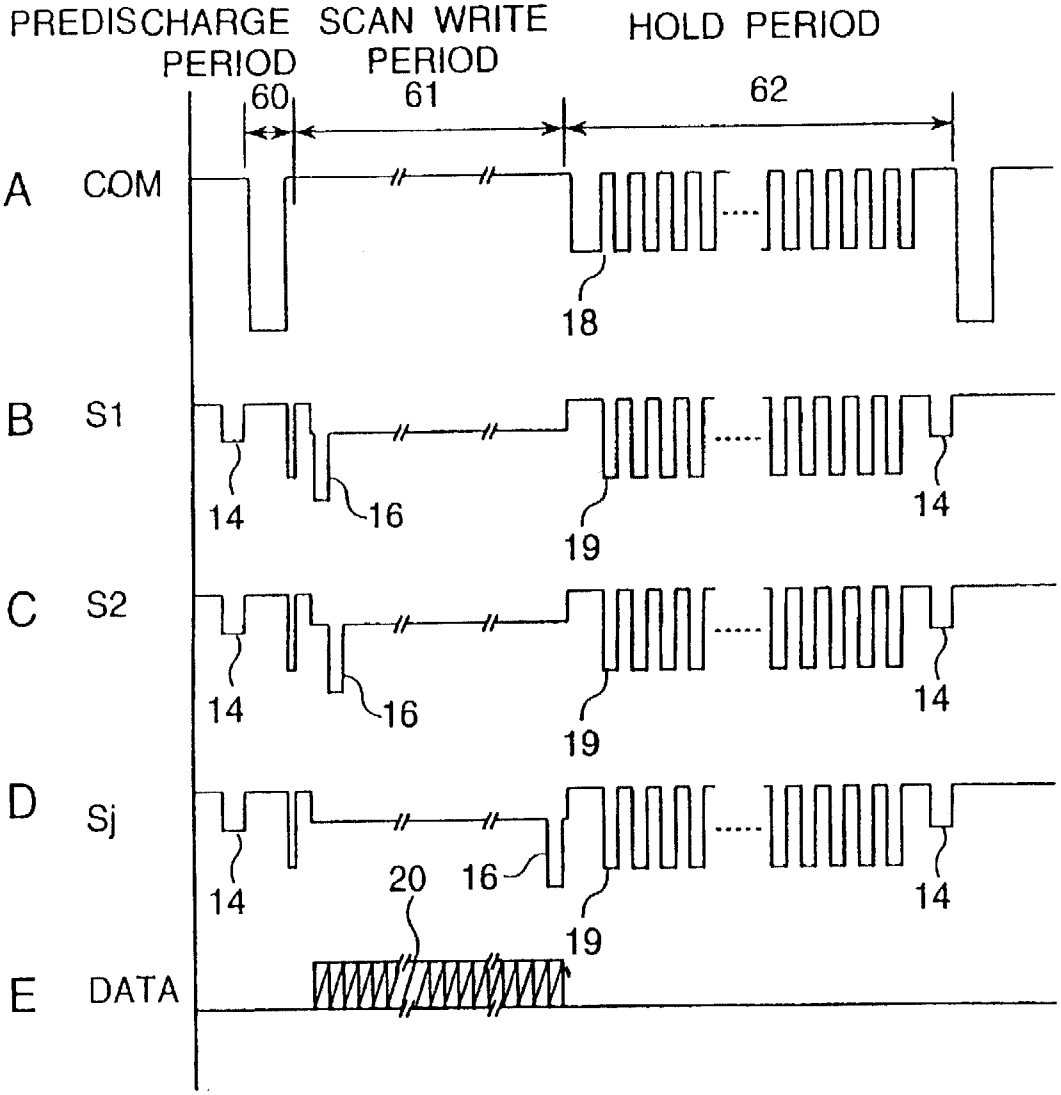
FIGURE 3 PRIOR ART
FIG. 3 is a timing chart illustrating various voltage waveforms applied in the plasma display panel.

In a scan write period (designated by "61" in FIG. 3) just before the hold period (designated by "62" in FIG. 3), the switch elements 22C and 24C are maintained in an off condition, and the switch element 65C is turned on, so that the high voltage side power supply terminal 63 of the scan pulse driving circuit 21 is fixed to VBW.

Figure 8:
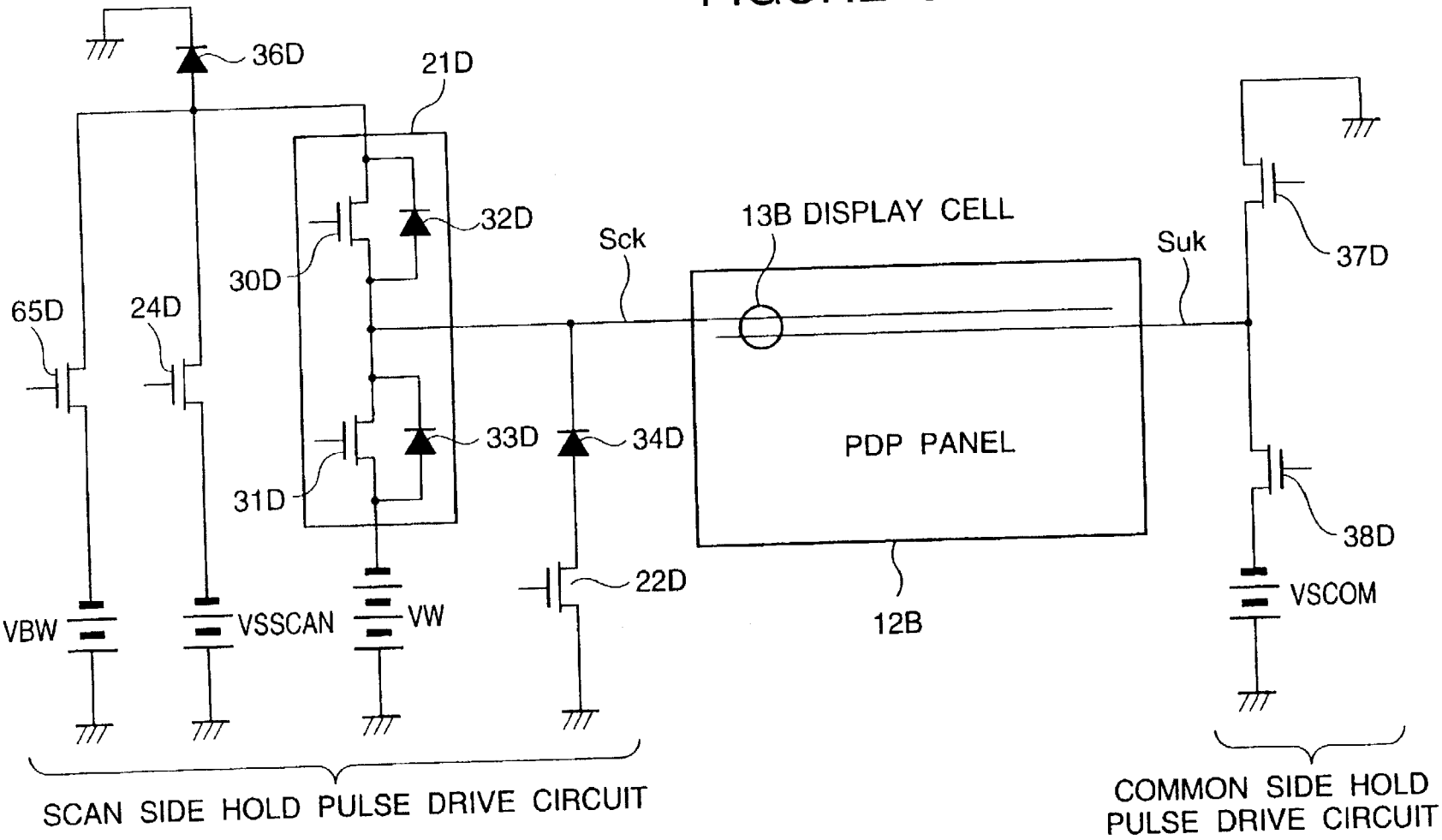
FIG. 8 is a detailed circuit diagram of an essential part of the first embodiment of the plasma display panel driving circuit shown in FIG. 6.

Next, an essential part of the first embodiment shown in FIG. 6 and an operation thereof will be described with reference to FIG. 8, which is a circuit diagram showing the essential part of the first embodiment of the plasma display panel driving circuit together with a plasma display panel 12B and a common side hold pulse drive circuit. In FIG. 8, elements corresponding in function to those shown in FIG. 6 are given the same Reference Numerals added with a suffix "D". In addition, for simplification of the drawing and the description, only one line is depicted in the plasma display panel 12B.

In FIG. 8, MOS transistors 22D and 24D and a diode 34D correspond to the switch elements 22C and 24C and one of diodes included in the diode array 34C, respectively, and constitute a scan side hold pulse drive circuit. In addition, MOS transistors 30D and 31D and diodes 32D and 33D included in an output stage of the scan pulse drive circuit 21 correspond to the switch elements 30 and 31 and the diodes 32 and 33 shown in FIG. 6, respectively. AMOS transistor 65D corresponds to the switch element 65C shown in FIG. 6. Furthermore, although omitted in FIG. 6, there is provided a cathode-grounded diode 36D having an anode connected in common to drains of the MOS transistors 24D, 30D and 65D and a cathode of the diode 32D.

A node connected in common to the MOS transistors 30D and 31D, an anode of the diode 32D and cathodes of the diodes 33D and 34D, is connected to a scan electrode Sck. A "k"th line of the plasma display panel 12B is located in parallel to this scan electrode Sck and a hold electrode Suk, and a number of display cells including a display cell 12B are provided along these electrodes.

One end of the hold electrode Suk is connected to drains of MOS transistors 37D and 38D. A source of the MOS transistor 37D is connected to the ground, and a source of the MOS transistor 38D is connected to a negative power supply VSCOM. These MOS transistors 37D and 38D constitute a common side hold pulse drive circuit.

Now, operation of the essential part shown in FIG. 8 will be described with reference to the timing chart shown in FIG. 7. First, a scan side hold pulse (corresponding to the pulse 19 shown in FIG. 3) will be described. At the time t1 shown in FIG. 7, the MOS transistor 24D is turned on by a control pulse generated by the pulse control circuit 26C. At this time, the MOS transistor 22D is turned off while MOS transistors 31D and 65D are maintained off, and the MOS transistor 30D is maintained on.

In this condition, a charging current as designated by Reference Numeral 50A in the waveform "C" of FIG. 7, flow to the scan electrode Sck through the diode 32D and the MOS transistor 24D. As a result, as shown in the waveform "A" Of FIG. 7, the output potential supplied to the scan electrode Sck drops from the ground level to the level of the negative power supply VSSCAN. Namely, this charging current 50A is a current flowing through the diode 32D within the scan pulse drive circuit 21.

After the output voltage reaches the level of VSSCAN, when a discharge delay time of several hundred nanoseconds has elapsed, a gas discharge current 51A flows between the scan electrode Sck and the hold electrode Suk as shown in the waveform "C" of FIG. 7. Since this gas discharge current 51A flows in the same direction as that of the charging current 50A, the gas discharge current 51A flows through the same path as that of the charging current 50A. A product of these currents 50A and 51A and a forward direction voltage drop of the diode 32D becomes a portion of the consumed electric power of the diode 32D, and hence the scan pulse drive circuit 21.

Thereafter, at the time t2, the transistor 24D is turned off, and the MOS transistor 22D is turned on. Thus, a discharge current flows to the scan electrode Sck through the MOS transistor 22D and the diode 34D, as designated by Reference Numeral 52A in the waveform "C" of FIG. 7. Therefore, the output potential supplied to the scan electrode Sck is pulled up and clamped to the ground level, as shown in the waveform "A" of FIG. 7. At this time, accordingly, the discharge current 52 (which discharges an electric charge accumulated in an electrostatic capacitance between the scan electrode Sck and the hold electrode Suk in the plasma display panel 12B) flows through a shunting diode 34D, without passing through the inside of the scan pulse drive circuit 21.

Next, the generation of the common side hold pulse will be described. In a period in which the common side hold pulse (corresponding to the pulse 18 shown in FIG. 3) is generated, the MOS transistor 22D in a scan side circuit is on, so that the output potential is clamped to the ground level. However, since the scan side circuit is connected to the common side hold pulse drive circuit through a capacitive coupling due to an electrostatic capacitance between the scan electrode Sck and the hold electrode Suk in the plasma display panel 12B, a current flows in the scan side circuit, as shown by Reference Numerals 53A, 54A and 55A in the waveform "C" of FIG. 7, due to a potential variation in the common side hold pulse drive circuit.

Namely, during a period from a time t3 to a time t4, the MOS transistor 38D is maintained on and the MOS transistor 37D is maintained off, so that the output potential supplied to the hold electrode Suk is clamped to the level of the negative power supply VSCOM connected to the transistor 38D, as shown in the waveform "B" of FIG. 7. In addition, at the time t3, since the scan electrode Sck is at the ground level and the hold electrode Suk is brought to the level of the negative power supply VSCOM, a charging current flows from the transistor 22D through the diode 34D to the electrostatic capacitance between the scan electrode Sck and the hold electrode Suk in the plasma display panel 12B, as shown by Reference Numeral 53A in the waveform "C" of FIG. 7.

After the output voltage supplied to the common side hold electrode had reached the level of VSCOM, when a discharge delay time of several hundred nanoseconds has elapsed, a gas discharge current 54A flows between the scan electrode Sck and the hold electrode Suk as shown in the waveform "C" of FIG. 7. Since this gas discharge current 54A flows in the same direction as that of the charging current 53A, the gas discharge current 54A flows through the same path as that of the charging current 53A. Namely, the charging current 53A and the gas discharge current 54A flow through the shunting diode 34D, without passing through the inside of the scan pulse drive circuit 21.

Thereafter, at the time t4, the transistor 38D is turned off, and the MOS transistor 37D is turned on. Thus, the output potential supplied to the common electrode Suk is pulled up through the MOS transistor 37D and clamped to the ground level, as shown in the waveform "B" of FIG. 7.

Furthermore, at the time t4, since the output potential supplied to the common electrode Suk is pulled up to the ground level as mentioned above, an electric charge accumulated in the electrostatic capacitance between the scan electrode Sck and the hold electrode Suk in the plasma display panel 12B is discharged by a discharge current 55A as shown in the waveform "C" of FIG. 7, which flows to the ground through the scan electrode Sck, the diode 32D, and the diode 36D for preventing the excessive voltage of the hold pulse.

The above mentioned sequence is repeated to generate the common side hold pulses.

As seen from the above, the first embodiment is characterized in that a major portion of the driving current, which had flown through the switch element 30 in the scan pulse drive circuit 21 of the prior art circuit shown in FIG. 4 at the time of generating the hold pulses, is caused to flow through the shunting diode 34D and the ground level clamping MOS transistor 22D (the shunting diode array 34C and the switch element 22C), without passing through the inside of the scan pulse drive circuit 21. Therefore, an electric power consumed by an on-resistance of the switch element 30 in the prior art can be greatly reduced.

Furthermore, although the driving current other than the above mentioned current passing through the shunting diode 34D, passes through the inside of the scan pulse drive circuit 21, since this driving current flows through the diode 32D having a very small impedance in the forward direction, the consumed electric power is relatively small. In addition, the scan pulse drive circuit 21 is not required to have a high impedance condition, so that the scan pulse drive circuit 21 itself and the control circuit for the scan pulse drive circuit 21 can be simplified in construction.

Figure 9:
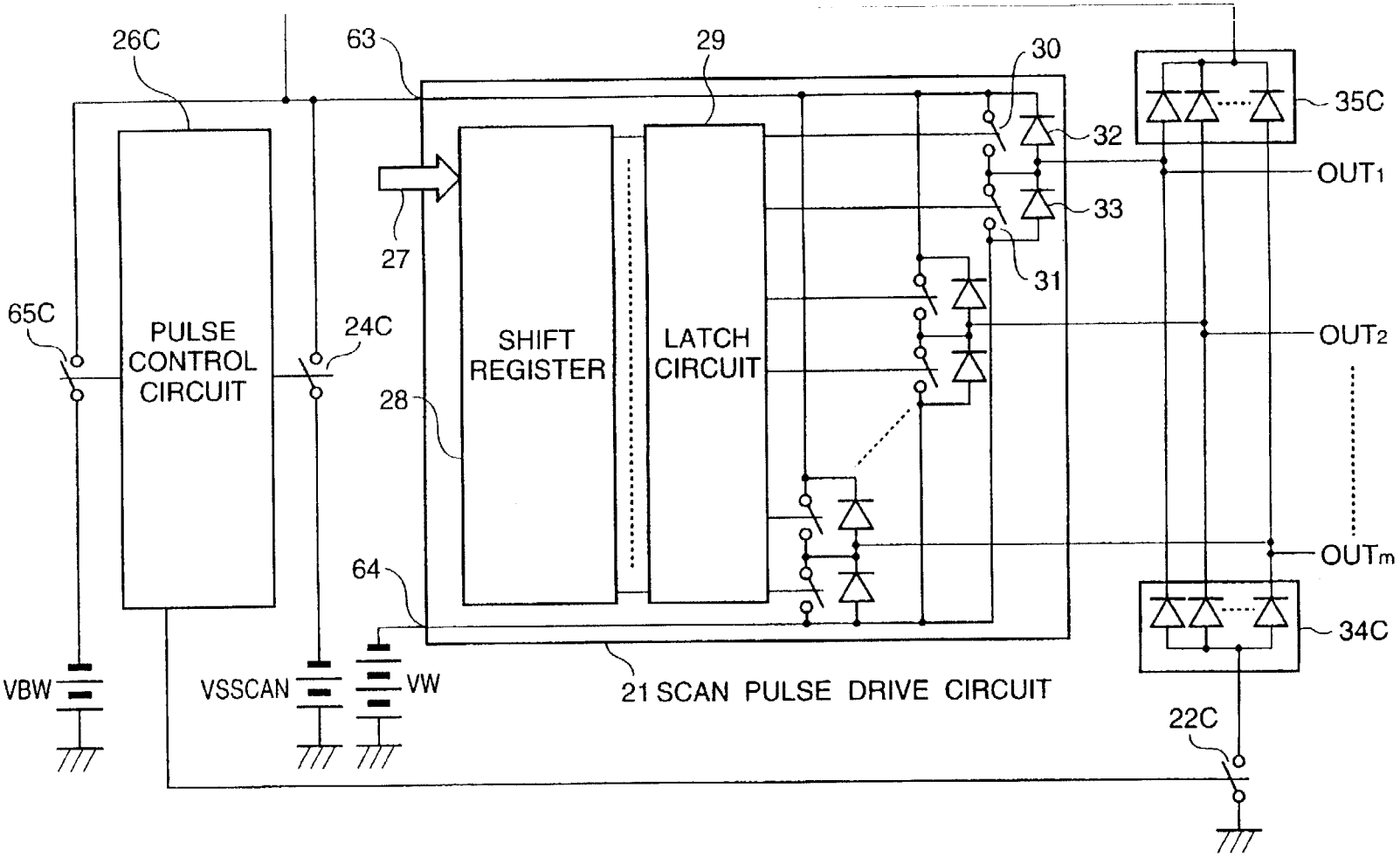
FIG. 9 is a block diagram of a second embodiment of the plasma display panel driving circuit in accordance with the present invention.

Now, a second embodiment of the plasma display panel driving circuit in accordance with the present invention will be described with reference to FIG. 9, which is a block diagram of the second embodiment. In FIG. 9, elements similar to those shown in FIG. 6 are given the same Reference Numerals, and explanation thereof will be omitted.

As seen from comparison between FIGS. 6 and 9, the second embodiment is different from the first embodiment in that the second embodiment additionally includes a diode array 35C composed of "m" diodes, all of which have a cathode connected in common to the connection node between the switch elements 24C and 65C and the high voltage side power supply terminal 63 of the scan pulse driving circuit 21. An anode of each of the diodes in the diode array 35 is connected to a corresponding one of the output terminals OUT1 to OUTm of the scan pulse driving circuit 21.

Next, operation of the second embodiment will be described with reference to the timing chart of FIG. 7.

At the time T1, the switch element 24C is turned on by the control pulse supplied from the pulse control circuit 26C. At this time, the switch elements 22C, 21 and 65C are maintained off, and the switch element 30 is maintained on.

Therefore, the charging current 50A flows through the diode 32 and the diode array 35C and through the output terminals OUT1 to OUTm to the scan electrodes, as shown by the waveform "C" of FIG. 7, with the result that the output potential is caused to drop from the ground level to the level of the negative power supply VSSCAN, as shown by the waveform "A" of FIG. 7. Namely, the charging current 50A flows through the diodes 32 within the scan pulse drive circuit 21 and the diode array 35C, with the charging current being divided into "m" shunted currents.

After the output voltage has reached the level of VSSCAN, when a discharge delay time of several hundred nanoseconds has elapsed, a gas discharge current 51A flows between the scan electrode and the hold electrode as shown in the waveform "C" of FIG. 7. Thereafter, at the time t2, the switch element 24C is turned off, and the switch element 22C is turned on. Thus, a discharge current flows to the scan electrode through the switch element 22C and the diode array 34C and and through the output terminals OUT1 to OUTm, as designated by Reference Numeral 52A in the waveform "C" of FIG. 7. Therefore, the output potential supplied to the scan electrode is pulled up and clamped to the ground level, as shown in the waveform "A" of FIG. 7. This sequence is repeated to generate the scan side hold pulses.

In this second embodiment, the hold pulse drive currents 50A, 51A and 55A passing through the diodes 32 within the scan pulse drive circuit 21 in the first embodiment, is shunted into the diode 32 and the diode array 35C, in accordance with an impedance ratio between the diode 32 and the diode of the diode array 35C.

With this arrangement, the hold pulse drive current which was not shunted in the first embodiment, is shunted through the diode array 35C provided externally of the scan pulse-drive circuit 21. Therefore, the electric power consumption can be loaded by a circuit external to the scan pulse drive circuit 21 of the integrated circuit. Accordingly, the electric power consumption of the scan pulse drive circuit 21 can further reduced in comparison with the first embodiment.

In the second embodiment, the smaller the impedance of the diode array 35C is than the impedance of the diode 32, the larger the effect of reducing the electric power consumption of the scan pulse drive circuit 21 becomes. In addition, since the scan pulse drive circuit 21 is not required to have a high impedance condition, the scan pulse drive circuit 21 itself and the control circuit for driving the scan pulse drive circuit 21 can be simplified in circuit construction.

However, in this embodiment, the driving current passes of necessity through the inside of the scan pulse drive circuit 21. Therefore, the effect of reducing the electric power consumption may not be sufficient to drive the plasma display panel of a large size or high definition, and therefore, having a large capacitance. However, a satisfactory effect of reducing the electric power consumption can be obtained in the case of driving the plasma display panel having a relative small capacitance.

Figure 10:
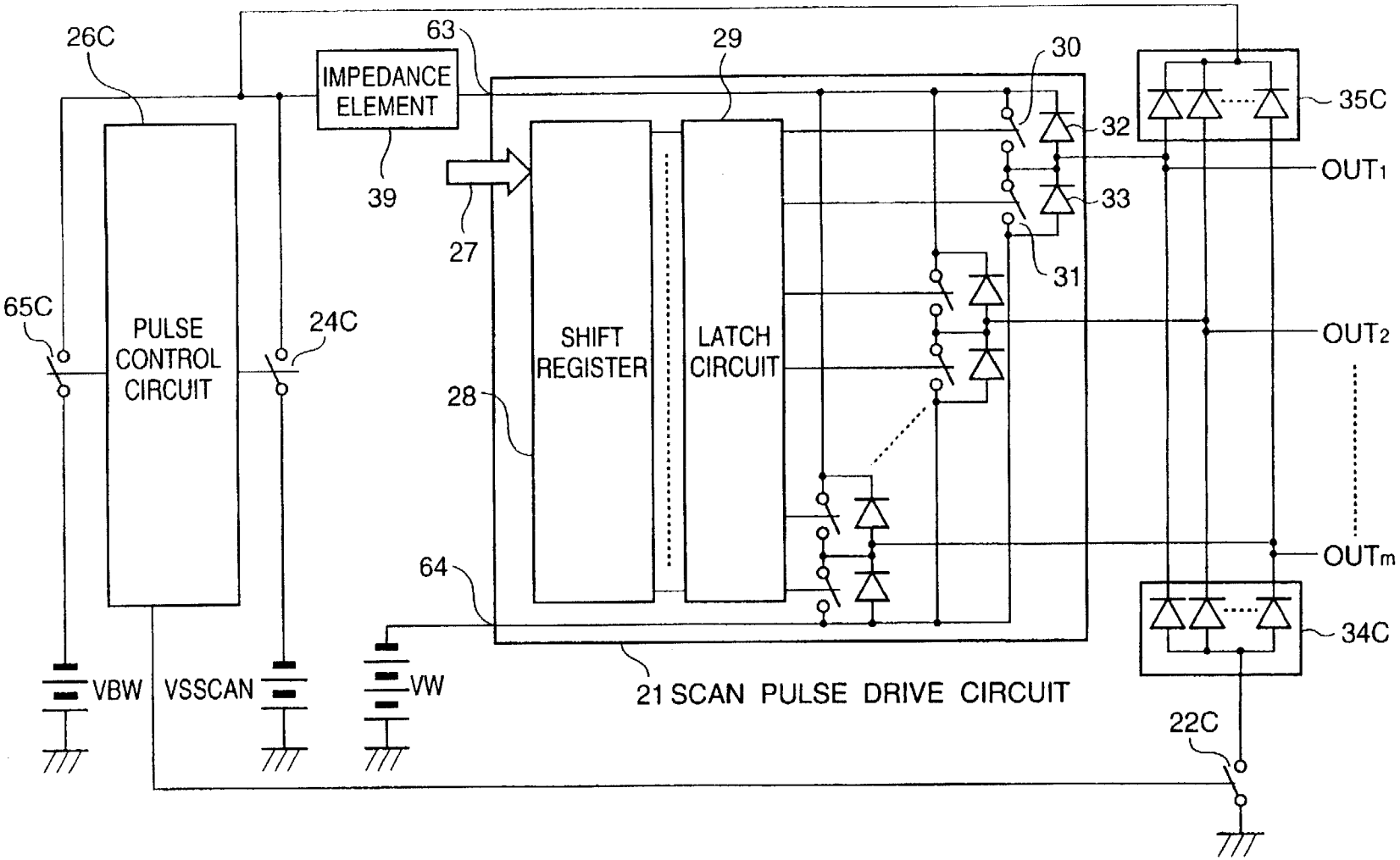
FIG. 10 is a block diagram of a third embodiment of the plasma display panel driving circuit in accordance with the present invention.

Now, a third embodiment of the plasma display panel driving circuit in accordance with the present invention will be described with reference to FIG. 10, which is a block diagram of the third embodiment. In FIG. 10, elements similar to those shown in FIGS. 6 and 9 are given the same Reference Numerals, and explanation thereof will be omitted.

The third embodiment is configured with the intention of further reducing the electric power consumption in comparison with the second embodiment. This third embodiment is characterized by additionally including an impedance element 39 connected between the high voltage side power supply terminal 63 of the scan pulse driving circuit 21 and the cathode of the diode array 35C.

In this third embodiment, since a line impedance from the diode 32 to the switch element 24C is elevated by the impedance element 39, the drive current flowing through the diode. 32 in the forward direction is further reduced in comparison with the second embodiment having no high impedance element 39. As a result, the consumed electric power of the scan pulse drive circuit 21 can be timber reduced. In this case, if the impedance of the inserted impedance element 39 is sufficiently higher than the forward direction impedance of each of the diodes included in the diode array 35C, a large effect of reducing the consumed electric power can be obtained.

However, since the impedance element 39 is inserted in series in the power supply line for outputting the scan pulse, a rising characteristics of the scan pulse is influenced. Namely, if the impedance of the impedance element 39 is large, a rising time of the scan pulse becomes large, so that the width of the scan pulse is increased, with the result that the time assigned to the scan write is restricted. For example, in order to make the rising time of the scan pulse several hundred nanoseconds, assuming that the number of the outputs of the scan pulse drive circuit 21 of the hold pulse drive circuit is 40 bits, and a load capacitance of the plasma display panel driven by one bit is about 50 pF, a desired result can be obtained when the impedance of the impedance element 39 is on the order of several ten ohms to several hundred ohms.

Figure 11A:
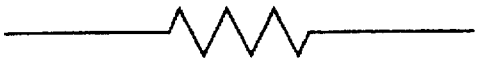
FIGS. 11A to 11E illustrate various impedance elements.
Figure 11B:
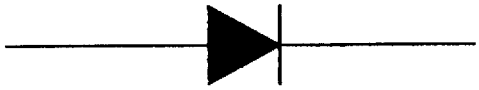
Figure 11C:
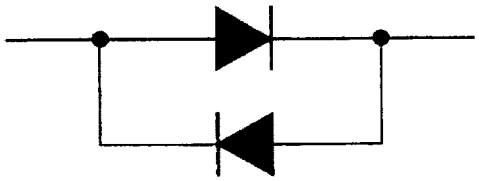
Figure 11D:
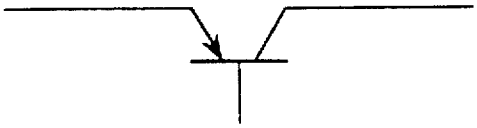
Figure 11E:
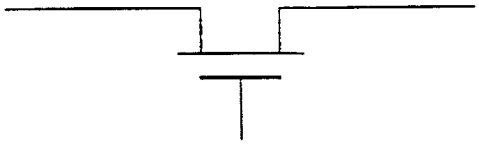

FIGS. 11A to 11E illustrate various examples of the impedance element 39. FIG. 11A shows a resistor, and FIG. 11B indicates a diode. FIG. 11C shows a construction composed of two diodes connected in parallel to each other but in a direction opposite to each other. FIG. 11D indicates a bipolar transistor, and FIG. 11E shows a field effect transistor.

The resistor, the diode and the two reverse-parallel connected diodes, as shown in FIGS. 11A, 11B and 11C, are very small and simple in construction, and require no special control signal. Therefore, these are very advantageous in an occupying area of an assembling and the manufacturing cost.

On the other hand, the active elements shown in FIGS. 11D and 11E can control the value of the impedance. During the hold period, the active element is controlled into a high impedance condition, so that the consumed electric power of the scan pulse drive circuit 21 is reduced, but during the scan write period, the active element is controlled into a low impedance condition, the rising time of the scan pulse can be shortened.

Incidentally, if an element other than the elements shown in FIGS. 11A to 11E fulfils the above mentioned condition, the other element can be used as the impedance element 39.

In the above mentioned embodiments, the level of the power supply VSSCAN connected to the power supply line of the scan pulse drive circuit 21 or another power supply voltage for supplying another pulse, is required to be equal to or higher than the level of the power supply VW which is a reference potential of the scan pulse drive circuit 21.

The reason for this is as follows. Explanation will be made with reference to FIG. 10 showing the third embodiment. If the applied voltage does not meet with the above mentioned condition, when the switch element 24C is turned on, a current flows through a path of the diode 33 and the diode array 35C, and through another path of the diodes 33 and 32 and the impedance element 39, respectively. At this time, since the mount of the current flowing through the path of the diode 33 and the diode array 35C, is limited by only the forward direction impedance of the diodes, there is possibility that an excessive current breaks the elements. On the other hand, the current flowing through the path of the diodes 33 and 32 and the impedance element 39, is limited by the impedance element 39, but there is also possibility that an excessive current breaks the elements, although it may be small.

Figure 12:
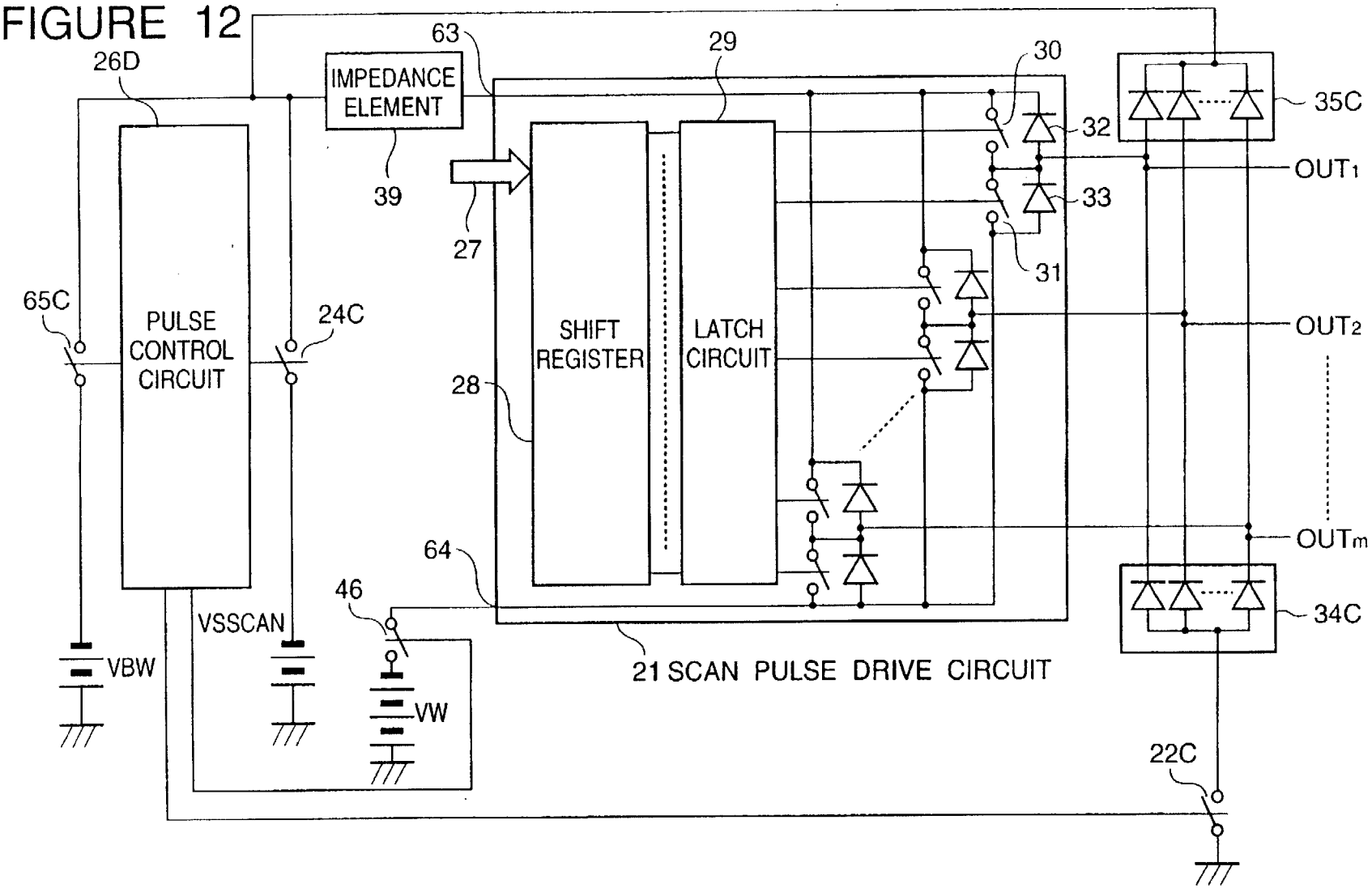
FIG. 12 is a block diagram of a fourth embodiment of the plasma display panel driving circuit in accordance with the present invention.

In order to improve the above mentioned restriction of the voltage relation of the applied voltages, a fourth embodiment of the plasma display panel driving circuit in accordance with the present invention is proposed as shown in FIG. 12, which is a block diagram of the fourth embodiment. In FIG. 12, elements similar to those shown in FIG. 10 are given the same Reference Numerals, and explanation thereof will be omitted.

The fourth embodiment is characterized in that, a switch element 46 on-off controlled by the pulse control circuit 26D, is inserted between the low voltage side power supply terminal 64 of the scan pulse driving circuit 21 and the negative power supply VW.

Now, operation of this fourth embodiment will be explained. First, in the scan write period, the switch element 46 is turned on by the control pulse outputted from the pulse control circuit 26D, and also the switch element 65C is turned on. Thus, the voltage of the negative power supply VBW is applied to the high voltage side power supply terminal 63 of the scan pulse driving circuit 21 through the switch element 65C and the impedance element 39, and on the other hand, the voltage of the negative power supply VW which is lower in potential than VBW, is applied to the low voltage side power supply terminal of the scan pulse driving circuit 21 through the switch element 46. The switch 30 and the switch 31 in the scan pulse driving circuit 21 are turned on and off in a relation complementary to each other, so that the output terminals OUT1 to OUTm are clamped to VW or VBW, so as to output the scan pulse. In this scan write period, the switch elements 22C and 24C are in no way turned on.

In the succeeding hold period, the, switch elements 46 and 65C are turned off, and the switch elements 22C and 24C are alternately turned on, so that the output terminals OUT1 to OUTm are clamped alternately to the voltage of the negative power supply VSSCAN or the ground potential through the diode arrays 34C and 35C. Namely, the hold pulses are generated in an operation similarly to that of the embodiments explained hereinbefore.

In this fourth embodiment, during a period of generating pulses other than the scan pulse, the reference voltage connected to the low voltage side power supply terminal 64 of the scan pulse driving circuit 21 is isolated from the negative power supply VW by action of the switch element 46, so that the reference voltage is fixed to the output voltage at hat free through the diodes 33 within the scan pulse driving circuit 21. Therefore, an excessive current can be prevented, and the restriction of the voltage relation of the voltages applied to the scan pulse driving circuit 21 can be cancelled.

Figure 13:
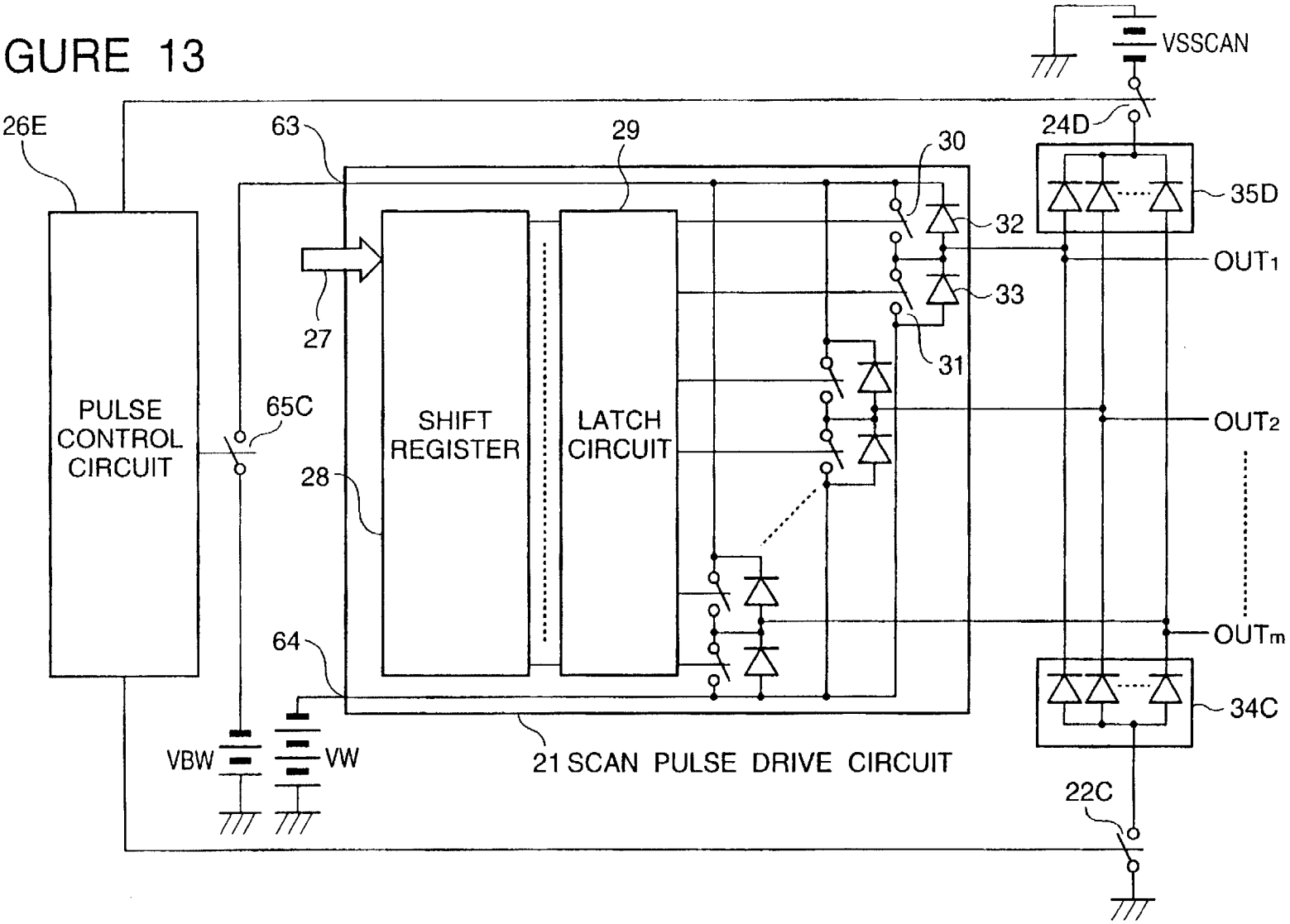
FIG. 13 is a block diagram of a fifth embodiment of the plasma display panel driving circuit in accordance with the present invention.

Now, a fifth embodiment of the plasma display panel driving circuit in accordance with the present invention will be described with reference to FIG. 13, which is a block diagram of the fifth embodiment. In FIG. 13, elements similar to those shown in FIG. 9 are given the same Reference Numerals, and explanation thereof will be omitted.

As seen from comparison between FIGS. 9 and 13, this fifth embodiment is characterized in that it includes a diode array 35D composed of "m" diodes having their anodes separately connected to the output terminals OUT1 to OUTm of the scan pulse driving circuit 21, respectively, a switch element 24D having one end thereof connected in common to cathodes of the "m" diodes included in the diode array 35D and the other end thereof connected to the negative power supply VSSCAN for fixing the potential of the hold pulse, and a pulse control circuit 26E for on-off controlling the switch elements 24D, 22C and 65C.

Next, operation of the fifth embodiment will be explained. First, in the scan write period, the switch element 65C is turned on, so that the voltage of the negative power supply VBW is applied to the high voltage side power supply terminal 63 of the scan pulse driving circuit 21 through the switch element 65C and the impedance element 39. On the other hand, the voltage of the negative power supply VW is applied to the low voltage side power supply terminal 64 of the scan pulse driving circuit 21. The switch 30 and the switch 31 in the scan pulse driving circuit 21 are turned on and off in a relation complementary to each other, so that the output terminals OUT1 to OUTm are clamped to VW or VBW, so as to output the scan pulse. In this scan write period, the switch elements 22C and 24C are in no way turned on.

In the succeeding hold period, the switch element 65C is turned off, so that the high voltage side power supply terminal 63 of the scan pulse driving circuit 21 is isolated from the negative power supply VBW. The switch elements 30 and 31 are turned on and off in a relation complementary to each other, in such a manner that when the switch element 30 is on, the switch element 31 is maintained off, and when the switch element 31 is on, the switch element 30 is maintained off, because the scan pulse drive circuit 21 does not have a high impedance function. In this condition, the switch elements 22C and 24D are on-off controlled in response to respective switching pulses from the pulse control circuit 26E, so that each of the output terminals OUT1 to OUTm is alternately clamped to the level of the negative power supply VSSCAN through the diode array 35D and the switch element 24D or the ground level through the diode array 34C and the switch 22C. Thus, the hold pulses are generated.

This fifth embodiment is characterized in that, during the hold period, no voltage is applied to the high voltage side power supply terminal 63 of the scan pulse driving circuit 21, and therefore, the high voltage side power supply terminal 63 of the scan pulse driving circuit 21 is fixed to the output potential at that time, namely, alternately to the level of the negative power supply VSSCAN or the ground potential.

Furthermore, the fifth embodiment is not required to have the high impedance function which had to be included in the scan pulse drive circuit 21 in the prior art shown in FIG. 5. Therefore, the scan pulse drive circuit 21 itself and the control circuit for the scan pulse drive circuit 21 can be simplified in construction. In addition, since the drive current for the hold pulse does not pass through the scan pulse drive circuit 21, the electric power consumption of the scan pulse drive circuit 21 can be reduced.

Figure 14:
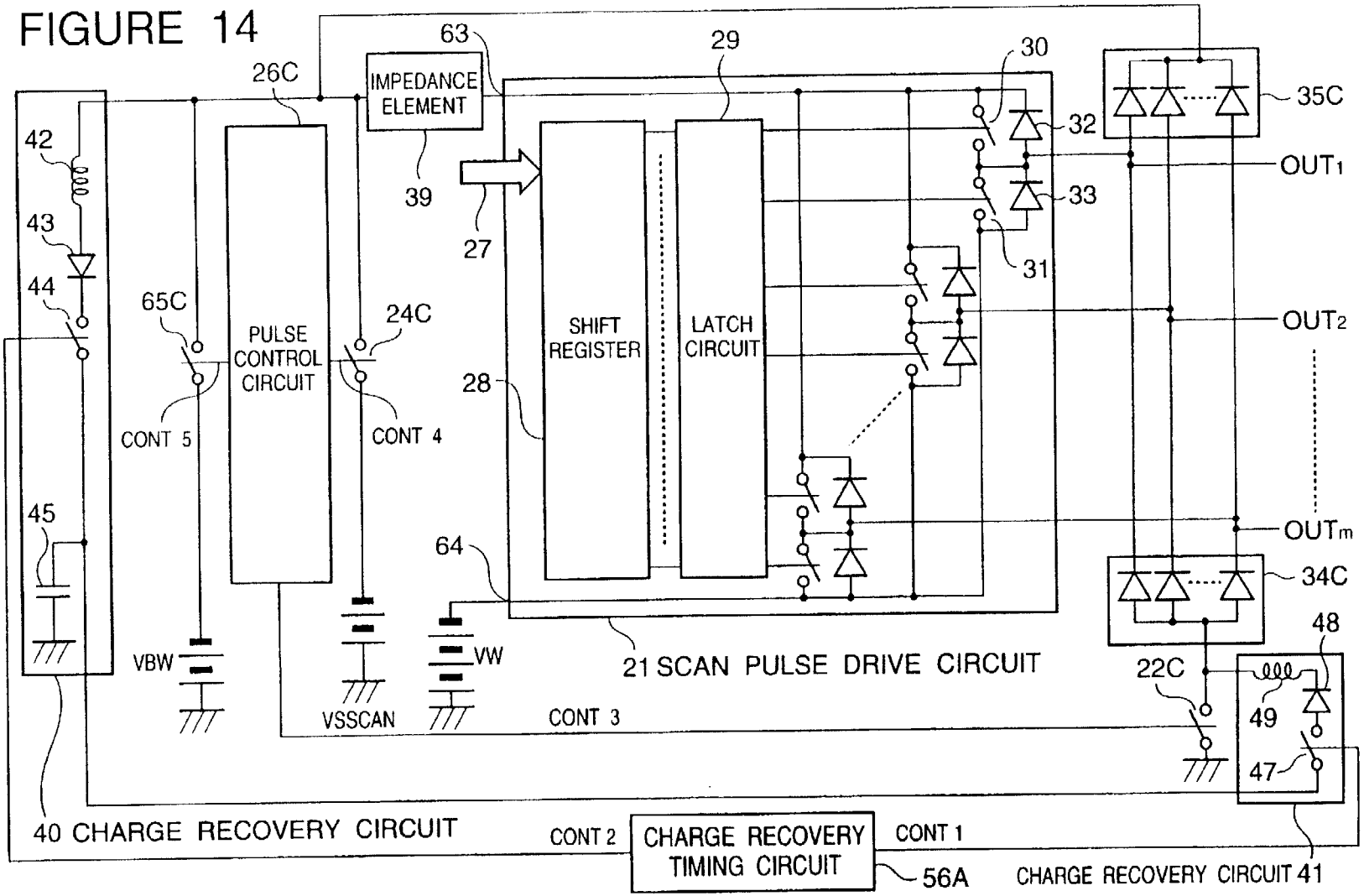
FIG. 14 is a block diagram of a sixth embodiment of the plasma display panel driving circuit in accordance with the present invention.

Now, a sixth embodiment of the plasma display panel driving circuit in accordance with the present invention will be described with reference to FIG. 14, which is a block diagram of the sixth embodiment. In FIG. 14, elements similar to those shown in FIG. 10 are given the same Reference Numerals, and explanation thereof will be omitted.

As seen from comparison between FIGS. 10 and 14, the sixth embodiment is characterized that, in addition to the construction of the third embodiment, it comprises an electric charge recovery circuit 40 connected through the impedance element 63 to the high voltage side power supply terminal 63 of the scan pulse driving circuit 21, another electric charge recovery circuit 41 connected to the common connection node between the anodes of the diode array 34C and the switch element 22C, and an electric charge recovery timing control circuit 56A for on-off controlling switch elements 44 and 47 included in the electric charge recovery circuits 40 and 41.

More specifically, the electric charge recovery circuit 40 includes a recovery inductor coil 42, a reverse-current preventing diode 43, the switch 44 and the recovery capacitor 45, which are connected in series in the named order between the one end of the high impedance element 63 and the ground. A connection node between the switch 44 and the recovery capacitor 45 is connected to the electric charge recovery circuit 41.

The electric charge recovery circuit 41 includes the switch 47, a reverse-current preventing diode 48 and a recovery inductor coil 49, which are connected in series in the named order between the connection node between the switch 44 and the recovery capacitor 45, and the anodes of the diodes included in the diode array 34C.

Next, operation. Of this sixth embodiment during the hold period will be explained with reference to FIG. 15, which is a timing chart illustrating the operation, during the hold period, of the plasma display panel driving circuit shown in FIG. 14.

Figure 15:
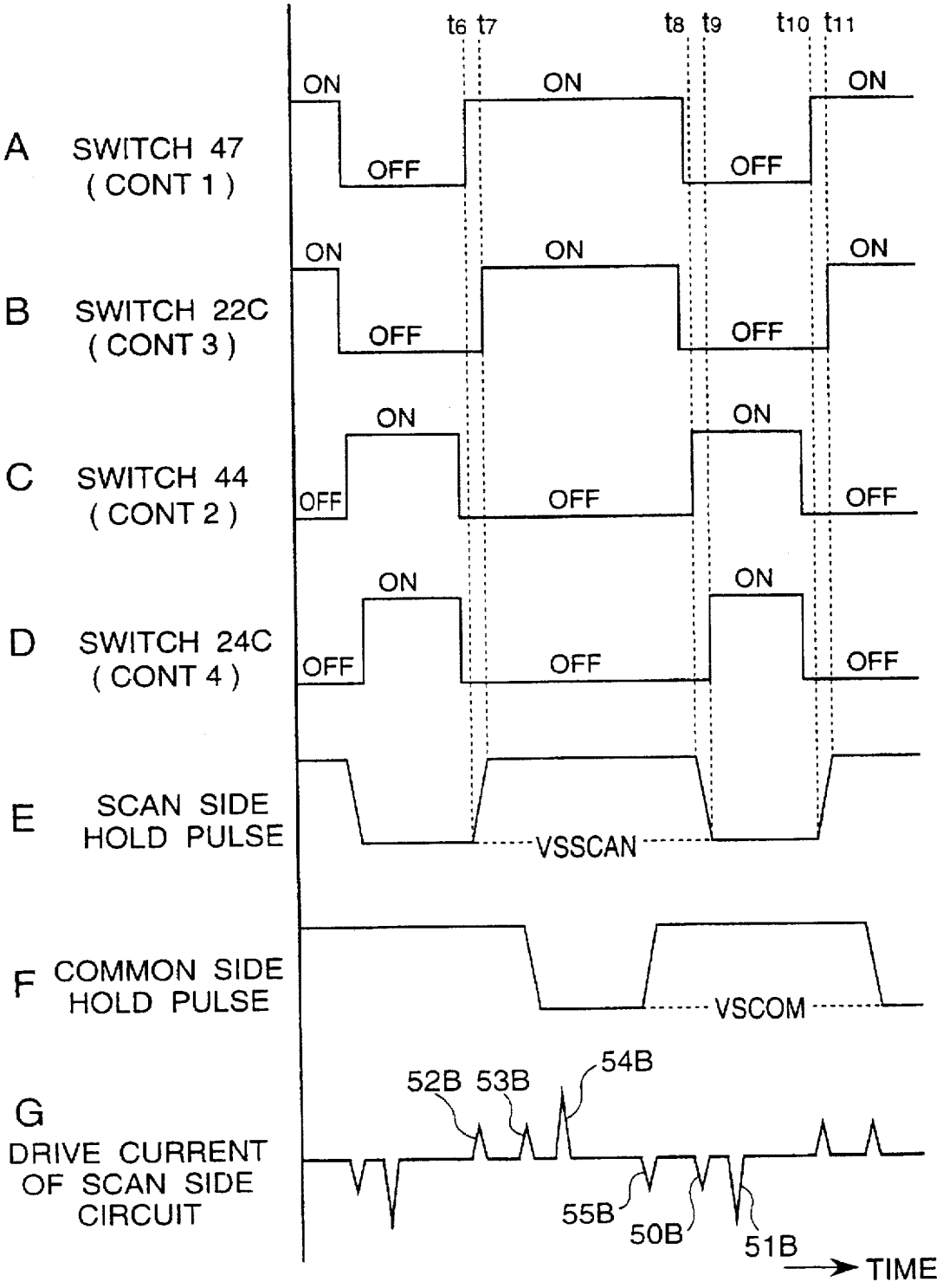
FIG. 15 is a timing chart illustrating an operation, during a hold period, of the plasma display panel driving circuit shown in FIG. 14.

First, the recovery timing control circuit 56A outputs a control signal CONT1 to the switch element 47 in the electric charge recovery circuit 41 so is to maintain the switch element 47 in an on condition from a time t6 to a time just before a time t8, as shown by the waveform "A" of FIG. 15. At the time t8, the recovery timing control circuit 56A outputs a control signal CONT2 to the switch element 44 in the electric charge recovery circuit 40 so as to bring the switch element 44 from an off condition to an on condition, as shown by the waveform "C" of FIG. 15. The recovery timing control circuit 56A maintains the switch element 44 in the on condition until a time just before a time t10.

Furthermore, the recovery timing control circuit 56A outputs a control signal CONT3 to the switch element 22C so as to bring the switch element 22C from an off condition to an on condition, at a time t7 just after the time t6, as shown by the waveform "B" of FIG. 15. Thereafter, the recovery timing control circuit 56A maintains the switch element 22C in the on condition until a time just before the time t8. Here, it is to be noted that a negative voltage lower than the negative power supply VSSCAN is charged in the capacitor 45, just before the time t6.

Thus, when the switch element 47 is turned on at the time t6, a discharge current 52B from the electrostatic capacitance of the display cell is supplied from the diode array 34C, the recovery coil 49, the diode 48 and the switch 47 to the capacitor 45. Namely, the electric charge accumulated in the electrostatic capacitance of the display cell is recovered, by the discharge current 52B, to the capacitor 45. Here, by setting a resonance frequency determined by a value of the recovery coil 49 and a value of the capacitor 45, it is possible to make the discharge current 52B abrupt.

During a period from the time t7 to the time t8, the scan electrode connected to the output terminal of the scan pulse drive circuit 21 is clamped to the ground level by action of the switch 22C and the diode array 34C.

Furthermore, during the period from the time t7 to the time t8, as mentioned hereinbefore, currents 53B, 54B and 55B as shown in the waveform "G" of FIG. 15 flow in the scan side circuit because of the potential variation of the common side hold pulse drive circuit transferred through the capacitive coupling.

Namely, after the time t7, the output voltage supplied to the hold electrode is clamped to the level of the negative power supply VSCOM as shown in the waveform "F" of FIG. 15, so that a charging current flows in the display cell through the switch element 22C and the diode array 34C, as designated by Reference Numeral 53B in the waveform "G" of FIG. 15.

After the common side hold output voltage reaches the level of VSCOM, when a discharge delay time of several hundred nanoseconds has elapsed, a gas discharge current 54B flows as shown in the waveform "G" of FIG. 15. Since this gas discharge current 54B flows in the same direction as that of the charging current 53B, the gas discharge current 54B flows through the same path as that of the charging current 53B. A product of these currents 50A and 51A and a forward direction voltage drop of the diode 32D becomes a portion of the consumed electric power of the diode 32D, and hence the scan pulse drive circuit 21.

Before the time t8, the potential of the common side hold electrode is pulled up and clamped to the ground level, as shown in the waveform "F" of FIG. 15. And, the electric charge accumulated in the electrostatic capacitance of the display cells of the plasma display panel, flows to the ground through the scan electrode, the diode 32 and a diode (not shown in FIG. 14) for preventing an excessive voltage of the hold pulse (corresponding to the diode 36D in FIG. 8), so that the electric charge is discharged by the discharge current 55B shown in the waveform "G" of FIG. 15. Thus, the above mentioned sequence is repeated to generate the common side hold pulse.

Succeedingly, if the switch element 44 is turned on at the time t8 by the control signal CONT2 from the recovery timing control circuit 56A, since the charged electric charge remains in the capacitor 45 just before the time t6 as mentioned above, a charging current 50B shown in the waveform "G" of FIG. 15 flows through a path starting from the display cell, passing through the diode 32, the impedance element 39, the recovery coil, the diode 43 and the switch 44, and reaching the capacitor 45, and also through another path starting from the display cell, passing through the diode array 35C, the recovery coil, the diode 43 and the switch 44, and reaching the capacitor 45.

In other words, the charging current 50B shown in the waveform "G" of FIG. 15 is supplied to the display cell by a first path from the recovery circuit 40 through the diode array 35C and by a second path from the recovery circuit 40 through the impedance element 39 and the diode 32.

From the time t8 to a time just before the time t10, the switch element 24C is maintained in the on condition by the control signal CONT4 from the pulse control circuit 26C, so that a current is supplied to the display cell through the switch element 24C and the diode array 35C, and further through the switch element 24C the impedance element 39 and the diode 32. As a result, the scan side hold pulse is clamped to the level of the negative power supply VSSCAN as shown by the waveform "E" of FIG. 15. At this time, since the impedance of the impedance element 39 is set to be sufficiently higher than those of the diodes included in the diode array 35C, a major portion of the above current passes through the diode array 35. Namely, a proportion of the current flowing through the inside of the scan pulse drive circuit 21 can be made small.

Thereafter, when a discharge delay time of several hundred nanoseconds has elapsed, a gas discharge current 51B flows as shown in the waveform "G" of FIG. 15. Since this gas discharge current 51B flows in the same direction as that of the charging current 50B, the gas discharge current 51B flows through the same path as that of the charging current 50B. Here, by setting a resonance frequency determined by a value of the recovery coil 42 and a value of the capacitor 45, it is possible to make the charging current 50B abrupt.

In this sixth embodiment, as mentioned above, the drive current of the hold pulse does not pass through the switch element 30 which has a relatively large on-impedance, but is shunted through the diode arrays 34C and 35C which are low in impedance. Therefore, since it is possible to reduce the line resistance which results in a drop of a recovery rate in an reactive power recovery operation, the reactive power recovery rate can be elevated. In this sixth embodiment, furthermore, since the scan pulse drive circuit 21 is not required to have the high impedance function, the scan pulse drive circuit 21 itself and the control circuit for the scan pulse drive circuit 21 can be simplified in construction.

In addition, since it is possible to the rising and the falling of the scan side hold pulse independently of each other, by separately setting the resonance frequency determined by the coil 42 and the capacitor 45 and the resonance frequency determined by the coil 49 and the capacitor 45, it is possible to optimize the rising and the falling of the scan side hold pulse although the current path for the scan side hold pulse is different between the rising time and the falling time and therefore the impedance of the current path for the scan side hold pulse is different between the rising time and the failing time.

Figure 16:
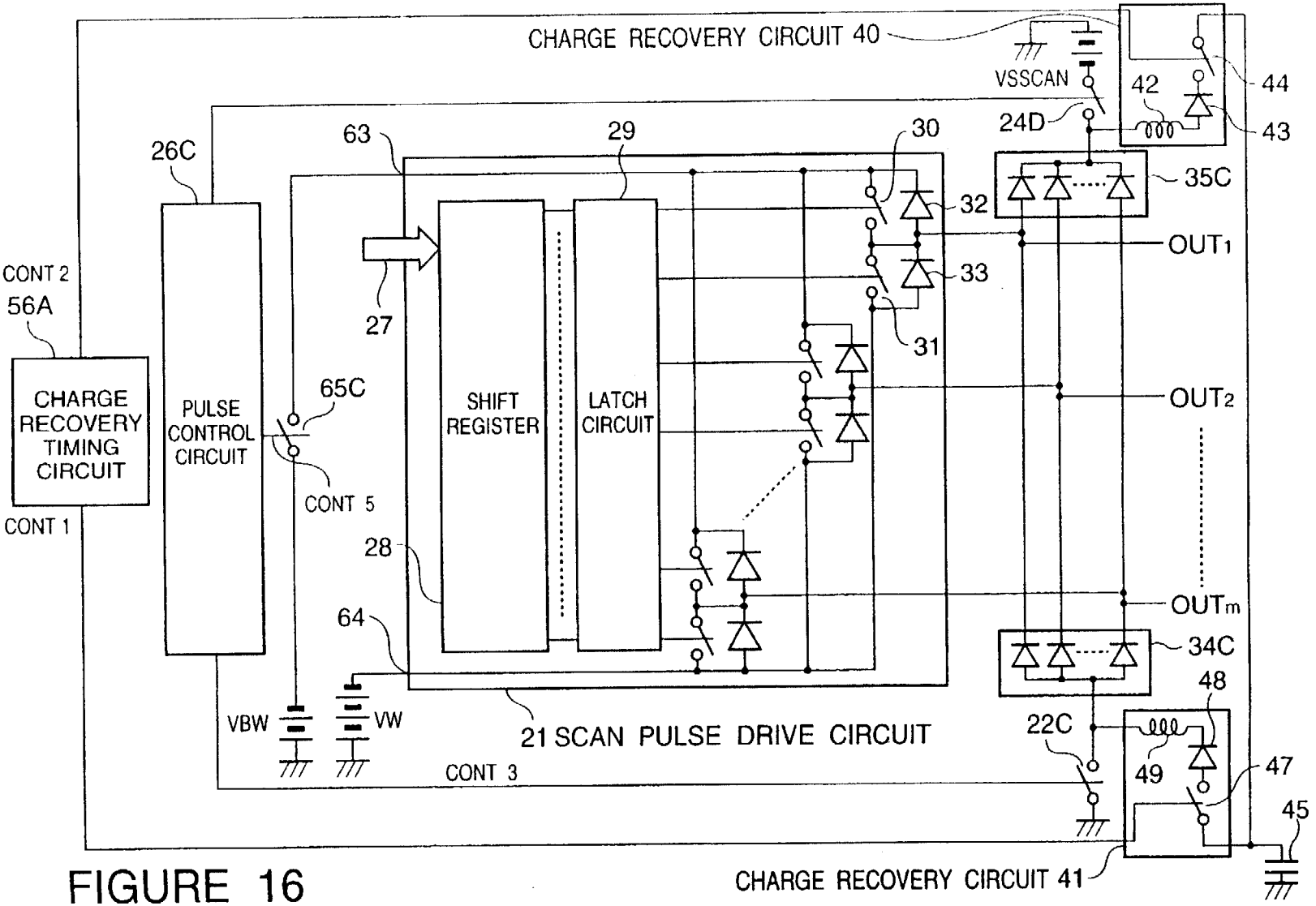
FIG. 16 is a block diagram of a seventh embodiment of the plasma display panel driving circuit in accordance with the present invention.

Next, a seventh embodiment of the plasma display panel driving circuit in accordance with the present invention will be described with reference to FIG. 16, which is a block diagram of the seventh embodiment. In FIG. 16, elements similar to those shown in FIGS. 13 and 14 are given the same Reference Numerals, and explanation thereof will be omitted.

This seventh embodiment is the fifth embodiment shown in FIG. 13 applied with the electric charge recovery system shown in FIG. 14. As shown in FIG. 16, one end of the recovery coil 42 in the recovery circuit 40 is connected to a connection node between the switch element 24D and the anodes of all the "m" diodes included in the diode array 35C.

Operation of the seventh embodiment will be omitted, because it is a combination of the operation of the fifth embodiment and the operation of the sixth embodiment, and therefore, would be apparent to persons skilled in the art from the above mentioned description of the fifth and sixth embodiments. In this seventh embodiment, since the hold pulse drive current does not flow through the scan pulse drive circuit 21, similarly to the above mentioned embodiments, the electric power consumption of the scan pulse drive circuit 21 can be reduced, and also the scan pulse drive circuit 21 itself and the control circuit for the scan pulse drive circuit 21 can be simplified in construction.

Figure 17:
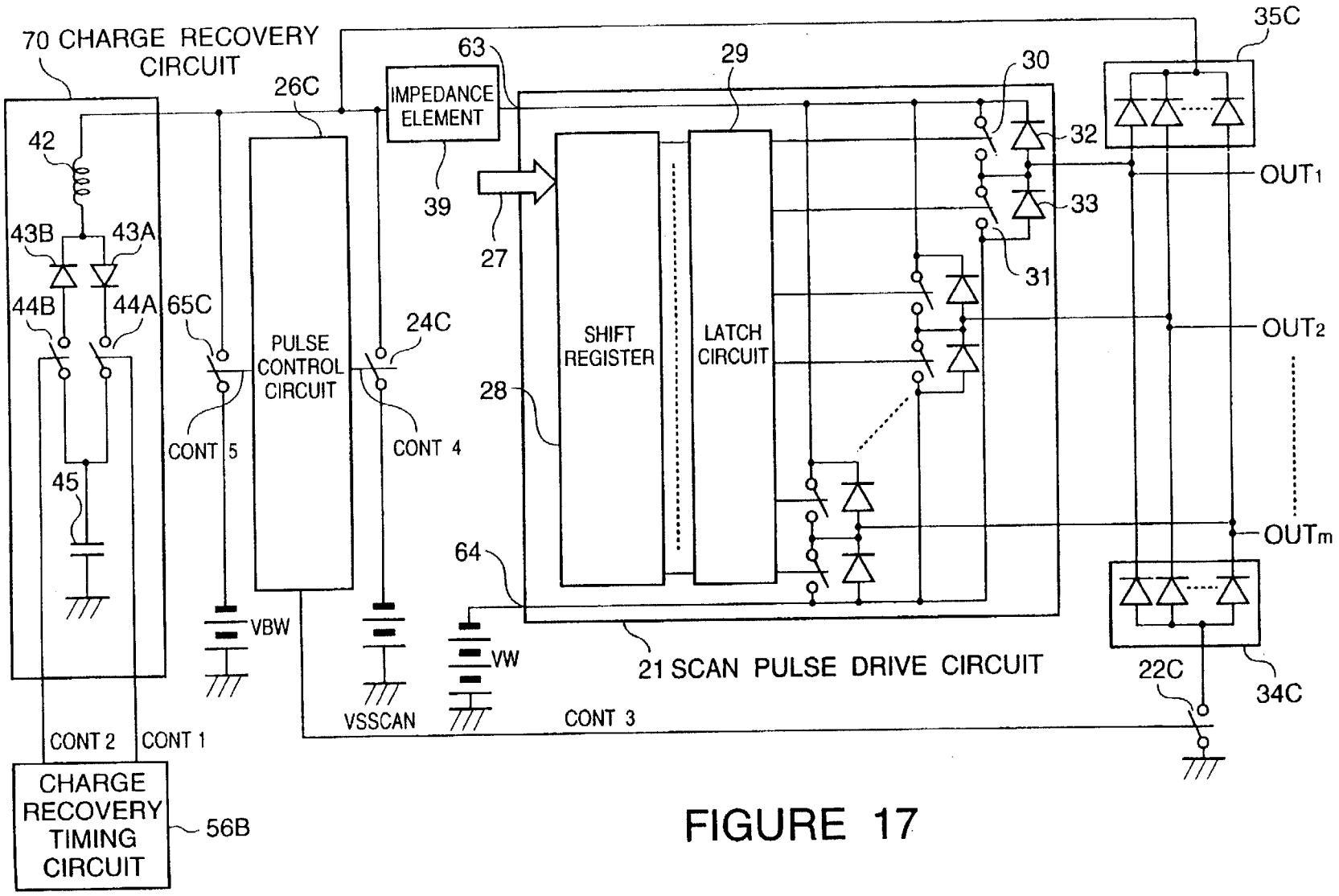
FIG. 17 is a block diagram of an eighth embodiment of the plasma display panel driving circuit in accordance with the present invention.

Now, an eighth embodiment of the plasma display panel driving circuit in accordance with the present invention will be described with reference to FIG. 17, which is a block diagram of the eighth embodiment. In FIG. 17, elements similar to those shown in FIG. 14 are given the same Reference Numerals, and explanation thereof will be omitted.

This eighth embodiment is constructed to be effective for a plasma display panel which has relatively small drive capacitance so that the drive current is permitted at some degree to pass through the scan pulse drive circuit 21. This eighth embodiment is characterized in that one electric charge recovery circuit 70 is controlled by one electric charge recovery timing control circuit 56B.

The electric charge recovery circuit 70 includes a parallel circuit constituted of a first series circuit composed of a diode 43A and a switch element 44A connected at its one end to a cathode of the diode 43A and a second series circuit composed of a diode 43B and a switch element 44B connected at its one end to an anode of the dime 43B, a recovery coil 42 having one end thereof connected to an anode of the diode 43A and a cathode of the diode 43B and the other end thereof connected to the common connection node between the switch elements 24C and 65C, the impedance element 39 and the diode array 35C, and a capacitor 45 connected between the ground and the other end of each of the switch elements 44A and 44B.

The switch elements 44A and 44B are controlled by control signals CONT1 and CONT2 generated by the, recovery timing control circuit 56B. These control signals CONT1, and CONT2 generated by the recovery timing control circuit 56B, are outputted at the same timings as the control signals CONT1 and CONT2 for the switch elements 47 and 44 shown in FIG. 15, respectively.

In this eighth embodiment, when the switch element 44B is on, the drive current flows through the impedance element 39. Therefore, in order to obtain a high electric charge recovery effect, the impedance element 39 is preferred to be constituted of an active element as shown in FIGS. 11D and 11E. In this Case, the active element is controlled to be put in a low impedance condition during an on period of the switch element 44B in the hold period, but in a high impedance during the other period of the hold period. With this, a high recovery effect can be obtained.

Furthermore, during the scan hold period, the active element is maintained in the low impedance condition, so as to shorten the rising time of the scan pulse.

In this eighth embodiment, the number of the recovery coils can be halved in comparison with the sixth embodiment, and therefore, it is advantageous in the manufacturing cost and in the required area of the circuit assembling.

Figure 1:
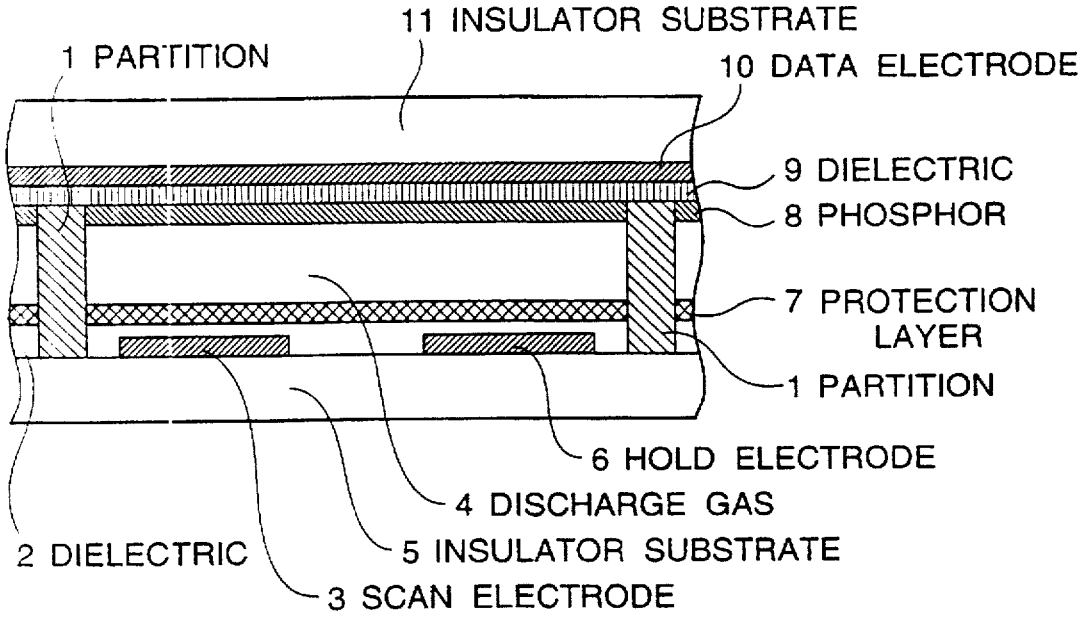
FIGURE 1 PRIOR ART
FIG. 1 is a diagrammatic sectional view of one display cell of the AC discharge, memory operation type of plasma display panel.
Figure 2:
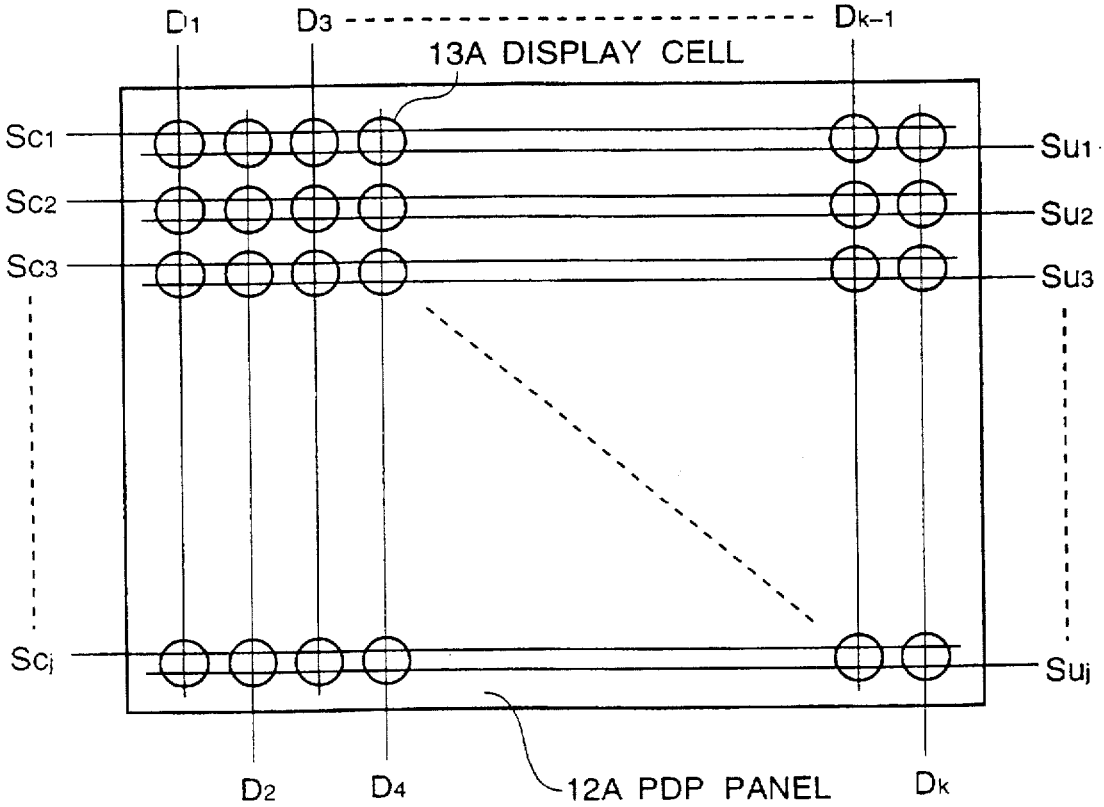
FIGURE 2 PRIOR ART
FIG. 2 illustrates a conventional electrode arrangement of the above mentioned AC discharge, memory operation type of plasma display panel.

The above mentioned embodiments have been described by taking as an example the three-electrode structure plasma display panel as shown in FIGS. 1 and 2, but the present invention is in no way limited to the three-electrode structure plasma display panel. For example, the present invention can be applied to the other types of plasma display panel which comprises an electrode having both of a scan electrode function and a hold electrode function, even if it is of a two-electrode structure type. In addition, the present invention can be applied to not only the AC type but also the DC type of the plasma display panel.

Furthermore, it is possible to make various modifications or additions by using the first embodiment as a basic construction, or to combine the fourth embodiment to any of the other embodiments.

As seen from the above, according to the present invention, the current supplied to the scan hold electrode is shunted to the diode array wholly or partially, without passing through the inside of the scan pulse drive circuit. Therefore, a major portion of an excessive drive current, such as a charging/discharging current of a plasma display panel capacitance and a gas discharge current, is prevented from passing through the inside of the scan pulse drive circuit, and accordingly, the electric power consumed in the inside of the scan pulse drive circuit realized as an integrated circuit, can be greatly reduced in comparison with the prior art.

In one variant of the present invention, a power supply voltage is not supplied to the scan pulse drive circuit during the hold period, and the power supply line of the scan pulse drive circuit is fixed to the output voltage at that time. With this arrangement, the scan pulse drive circuit is no longer required to provide the high impedance function. Therefore, the scan pulse drive circuit itself and a control circuit for the scan pulse drive circuit can be simplified in construction.

In another variant of the present invention, first and second diode arrays are provided to shunt the drive current for the hold pulse so as to avoid the drive current from passing through the inside of the scan pulse drive circuit. In addition, a reactive electric power can be recovered in a capacitor. Accordingly, a sufficient drive power can be realized. In one embodiment, since one coil can be used in common for the electric charge recovery circuit, the construction of the electric charge recovery circuit can be simplified.

As seen from the above, the present invention can drive the scan hold electrodes of a large sized or a high definition plasma display panel having a large number of electrodes and therefore a large display capacitance, without permitting an excessive current but with using the conventional scan pulse drive integrated circuit.

The invention has thus been shown and described with reference to the specific embodiments. However, it should be noted that the present invention is in no way limited to the details of the illustrated structures but changes and modifications may be made within the scope of the appended claims.

We claim:

1. A circuit for driving scan hold electrodes in a plasma display panel which comprises at least a plurality of scan hold electrodes having a scan electrode function and a hold electrode function, and a plurality of data electrodes orthogonal to said scan hold electrodes, the circuit comprising:

a scan pulse drive circuit including an integrated circuit and having a plurality of output terminals for outputting scan pulses to said scan hold electrodes;

a first diode array including a plurality of diodes, each having a cathode connected to a corresponding one of said plurality of output terminals;

a first switch element connected between an anode of each of said plurality of diodes of said first diode array and a first power supply;

a second switch element connected between a high voltage side power supply terminal of said scan pulse driving circuit and a second power supply having a potential lower than that of said first power supply; and a pulse control circuit for alternately turning on said first switch element and said second switch element at least during a hold period.

2. A circuit claimed in claim 1 further including a third switch element connected between said high voltage side power supply terminal of said scan pulse driving circuit and a third power supply having a potential lower than that of said first power supply, and wherein said pulse control circuit controls an on-off switching of said third switch element at least during a scan write period.

3. A circuit claimed in claim 1 further including a second diode array including a plurality of diodes, each having an anode connected to a corresponding one of said plurality of output terminals, a cathode of each diode in said second diode array being connected to said high voltage side power supply terminal of said scan pulse driving circuit.

4. A circuit claimed in claim 2 further including an impedance element inserted between said high voltage side power supply terminal of said scan pulse driving circuit and said second switch element and said third switch element.

5. A circuit for driving scan hold electrodes in a plasma display panel which comprises at least a plurality of scan hold electrodes having a scan electrode function and a hold electrode function, and a plurality of data electrodes orthogonal to said scan hold electrodes, the circuit comprising:

a scan pulse drive circuit comprising an integrated circuit and having a plurality of output terminals for outputting scan pulses to said scan hold electrodes;

a first diode array including a plurality of diodes, each having a cathode connected to a corresponding one of said plurality of output terminals;

a second diode array comprising a plurality of diodes, each having an anode connected to a corresponding one of said plurality of output terminals;

a first switch element connected between an anode of each of said plurality of diodes of said first diode array and a first power supply;

a second switch element connected between a cathode of each of said plurality of diodes of said second diode array and a second power supply;

a third switch element connected between a high voltage side power supply terminal of said scan pulse driving circuit and a third power supply having a potential lower than that of said first power supply; and a pulse control circuit for alternately turning on said first switch element and said third switch element at least during a hold period, said pulse control circuit controlling an on-off switching of said second switch element at least during a scan write period.

6. A circuit claimed in claim 3 further including:

a fourth switch element and a fifth switch element;

a timing control circuit for controlling an on-off switching of each of said fourth switch element and said fifth switch element;

a first series circuit including a first coil and a first reverse-current preventing diode and connected between said high voltage side power supply terminal of said scan pulse driving circuit and one end of said fourth switch element;

a second series circuit including a second coil and a second reverse-current preventing diode and connected between a common connection node between the anode of said diodes of said first diode array and one end of said fifth switch element; and a capacitor having one end thereof connected to the other end of each of said fourth switch element and said fifth switch element and said first power supply.

7. A circuit claimed in claim 6 further including an impedance element inserted between said high voltage side power supply terminal of said scan pulse driving circuit and a common connection node between said second switch elements, and a third switch element, said second diode array and said first series circuit.

8. A circuit claimed in claim 5 further including:

a fourth switch element and a fifth switch element;

a timing control circuit for controlling an on-off switching of each of said fourth switch element and said fifth switch element;

a first series circuit including a first coil and a first reverse-current preventing diode and connected between a common connection node between the cathode of said diodes of said second diode array and one end of said fourth switch element;

a second series circuit including a second coil and a second reverse-current preventing diode and connected between a common connection node between the anode of said diodes of said first diode array and one end of said fifth switch element; and a capacitor having one end thereof connected to the other end of each of said fourth switch element and said fifth switch element and said first power supply.

9. A circuit claimed in claim 3 further including:

a third switch element, a fourth switch element and a fifth switch element;

a timing control circuit for controlling an on-off switching of each of said fourth switch element and said fifth switch element;

a coil having one end thereof connected to said high voltage side power supply terminal of said scan pulse driving circuit;

a first reverse-current preventing diode having an anode connected to the other end of said coil and a cathode connected to one end of said fourth switch element;

a second reverse-current preventing diode having a cathode connected to the other end of said coil and an anode connected to one end of said fifth switch element; and a capacitor having one end thereof connected to the other end of each of said fourth switch element and said fifth switch element and said first power supply.

10. A circuit claimed in claim 9 further including an impedance element inserted between said high voltage side power supply terminal of said scan pulse driving circuit and a common connection node between said second switch element and said third switch element, said second diode array and said coil.

11. A circuit claimed in claim 2 further including a sixth switch element having one end thereof connected to a low voltage side power supply terminal of said scan pulse driving circuit and the other end thereof connected to a fourth power supply having a potential lower than that of said second power supply, said sixth switch element being turned on together with said third switch element at least during said scan write period, but being turned off during the hold period.

12. A circuit claimed in claim 5 further including:

a fourth switch element and a fifth switch element;

a timing control circuit for controlling an on-off switching of each of said fourth switch element and said fifth switch element;

a coil having one end thereof connected to said high voltage side power supply terminal of said scan pulse driving circuit;

a first reverse-current preventing diode having an anode connected to the other end of said coil and a cathode connected to one end of said fourth switch element;

a second reverse-current preventing diode having a cathode connected to the other end of said coil and an anode connected to one end of said fifth switch element; and a capacitor having one end thereof connected to the other end of each of said fourth switch element and said fifth switch element and said first power supply.

13. A circuit claimed in claim 12 further including an impedance element inserted between said high voltage side power supply terminal of said scan pulse driving circuit and a common connection node between said second switch element and said third switch element, said second diode array and said coil.

14. A circuit claimed in claim 5 further including a sixth switch element having one end thereof connected to a low voltage side power supply terminal of said scan pulse driving circuit and the other end thereof connected to a fourth power supply having a potential lower than that of said second power supply, said sixth switch element being turned on together, said third switch element at least during said scan write period, but being turned off during the hold period.

* * * * *